US012041975B2

(12) United States Patent
Blecha et al.

(10) Patent No.: US 12,041,975 B2
(45) Date of Patent: Jul. 23, 2024

(54) SOCKS HAVING INTEGRATED GRIPPING SYSTEMS

(71) Applicant: Lululemon Athletica Canada Inc., Vancouver (CA)

(72) Inventors: Joseph Simon Blecha, Arch Cape, OR (US); Kenneth Todd Craig, Portland, OR (US); Brittany Autumn Woodward, Portland, OR (US); Christopher Ka-Yin Lam, Portland, OR (US)

(73) Assignee: Lululemon Athletica Canada Inc., Vancouver (CA)

( * ) Notice: Subject to any disclaimer, the term of this patent is extended or adjusted under 35 U.S.C. 154(b) by 194 days.

(21) Appl. No.: 17/513,728

(22) Filed: Oct. 28, 2021

(65) Prior Publication Data

US 2022/0125128 A1 Apr. 28, 2022

Related U.S. Application Data

(60) Provisional application No. 63/106,646, filed on Oct. 28, 2020.

(51) Int. Cl.

| | |
|---|---|
| ***A41B 11/00*** | (2006.01) |
| ***D04B 1/12*** | (2006.01) |
| ***D04B 1/26*** | (2006.01) |
| ***D04B 9/46*** | (2006.01) |

(52) U.S. Cl.

CPC ..... *A41B 11/003* (2013.01); *D04B 1/12* (2013.01); *D04B 1/26* (2013.01); *D04B 9/46* (2013.01)

(58) Field of Classification Search

CPC ... D04B 1/12; D04B 1/26; D04B 9/46; D04B 9/52; A41B 11/003; A41B 2500/10; A61F 13/08

See application file for complete search history.

(56) References Cited

U.S. PATENT DOCUMENTS

| | | | |
|---|---|---|---|
| 1,553,811 A | 9/1925 | Gilbert | |
| 2,384,079 A | 9/1945 | Davis | |
| 3,793,851 A | 2/1974 | Thorneburg | |
| 4,057,981 A | 11/1977 | Runac | |

(Continued)

FOREIGN PATENT DOCUMENTS

| | | | |
|---|---|---|---|
| EP | 2511404 A2 * | 10/2012 | ..... D04B 1/108 |
| GB | 2530171 A * | 3/2016 | ..... D04B 1/14 |

(Continued)

*Primary Examiner* — Aiying Zhao

(74) *Attorney, Agent, or Firm* — Kolitch Romano Dascenzo Gates LLC

(57) ABSTRACT

Socks or stockings including integrated gripping systems include gripping material disposed on external surfaces of a sole of the sock and gripping material disposed on internal surfaces of the sock. In some examples, the integrated gripping systems comprise a first set of gripping dots comprising gripping material applied to external surfaces of the sole of the sock and a second set of gripping dots comprising gripping material applied to internal surfaces of the sole of the sock. In some examples, the integrated gripping systems comprise a knitted fabric including gripping yarn, which includes knitted gripping portions disposed on internal surfaces of the sock and external surfaces of the sock.

17 Claims, 14 Drawing Sheets

(56) References Cited

U.S. PATENT DOCUMENTS

| | | | | | |
|---|---|---|---|---|---|
| 4,104,892 | A * | 8/1978 | Thorneburg | A41B 11/02 | 66/178 R |
| 4,277,959 | A | 7/1981 | Thorneburg | | |
| 4,732,015 | A | 3/1988 | Abrams et al. | | |
| 5,412,957 | A * | 5/1995 | Bradberry | A61F 13/08 | 66/178 A |
| 5,708,984 | A | 1/1998 | Shofner | | |
| 5,708,985 | A * | 1/1998 | Ogden | D04B 1/04 | 66/178 R |
| 5,724,836 | A | 3/1998 | Green | | |
| 7,748,240 | B1 * | 7/2010 | Cherneski | A41B 11/008 | 66/185 |
| 9,498,003 | B2 * | 11/2016 | Cherneski | D04B 11/28 | |
| 2007/0094892 | A1 | 5/2007 | Craig et al. | | |
| 2008/0041113 | A1 | 2/2008 | Mori et al. | | |
| 2015/0047103 | A1 | 2/2015 | Dahlgren et al. | | |
| 2016/0166419 | A1 | 6/2016 | Jones et al. | | |
| 2016/0340813 | A1 * | 11/2016 | Amis | D04B 1/26 | |
| 2017/0332703 | A1 | 11/2017 | Amis et al. | | |
| 2019/0029331 | A1 | 1/2019 | Field | | |
| 2020/0221791 | A1 * | 7/2020 | Gazit | A41B 11/008 | |
| 2020/0347530 | A1 * | 11/2020 | Tannebaum | D04B 1/04 | |
| 2020/0399801 | A1 | 12/2020 | Ogden | | |
| 2022/0117318 | A1 | 4/2022 | Polegato Moretti et al. | | |

FOREIGN PATENT DOCUMENTS

| | | | | | |
|---|---|---|---|---|---|
| JP | 2006249596 | A * | 9/2006 | | |
| WO | WO-2015094385 | A1 * | 6/2015 | A61F 13/06 | |

* cited by examiner

SOCKS HAVING INTEGRATED GRIPPING SYSTEMS

CROSS-REFERENCES

The following applications and materials are incorporated herein, in their entireties, for all purposes: U.S. Provisional Patent Application Ser. No. 63/106,646, filed Oct. 28, 2020.

FIELD

This disclosure relates to systems and methods for stockings or socks. More specifically, the disclosed embodiments relate to stockings or socks having gripping capabilities.

INTRODUCTION

Yoga, dance, and other movement arts are often practiced barefoot. However, in some circumstances, it may be beneficial for a practitioner to wear socks while performing an activity. Socks may protect the feet from friction or keep the wearer warm. However, conventional socks often do not grip the floor, and may increase a risk of slipping for the wearer or reduce the wearer's sense of balance. Gripping socks may provide some or all of the benefits of conventional socks while reducing slip risk and enhancing performance.

SUMMARY

The present disclosure provides systems, apparatuses, and methods relating to socks having integrated gripping systems.

In some examples, stockings of the present disclosure include: a knit sock; a first pattern of discrete external gripping surfaces disposed on an exterior surface of the knit sock; and a second pattern of discrete internal gripping surfaces disposed on an interior surface of the knit sock; wherein the internal gripping surfaces are out of registration with respect to the external gripping surfaces, such that the first and second patterns are configured to improve traction by producing a shearing vector between foot-to-sock frictional forces and sock-to-underlying surface frictional forces.

In some examples, gripping socks of the present disclosure include: a knit sock portion; and a functional yarn woven into the knit sock portion, wherein the functional yarn is exposed on an exterior surface of the knit sock portion in a first pattern, and exposed on an interior surface of the knit sock portion in a second pattern; wherein the first pattern is out of registration with the second pattern.

In some examples, stockings of the present disclosure may include: a knit sock; a first pattern of discrete external gripping surfaces disposed on an exterior surface of the knit sock; and a second pattern of discrete internal gripping surfaces disposed on an interior surface of the knit sock; wherein the internal gripping surfaces are out of registration with respect to the external gripping surfaces, and the first pattern has a different density than the second pattern, as measured by a number of the gripping surfaces per centimeter.

Features, functions, and advantages may be achieved independently in various embodiments of the present disclosure, or may be combined in yet other embodiments, further details of which can be seen with reference to the following description and drawings.

DETAILED DESCRIPTION

Figure 1:
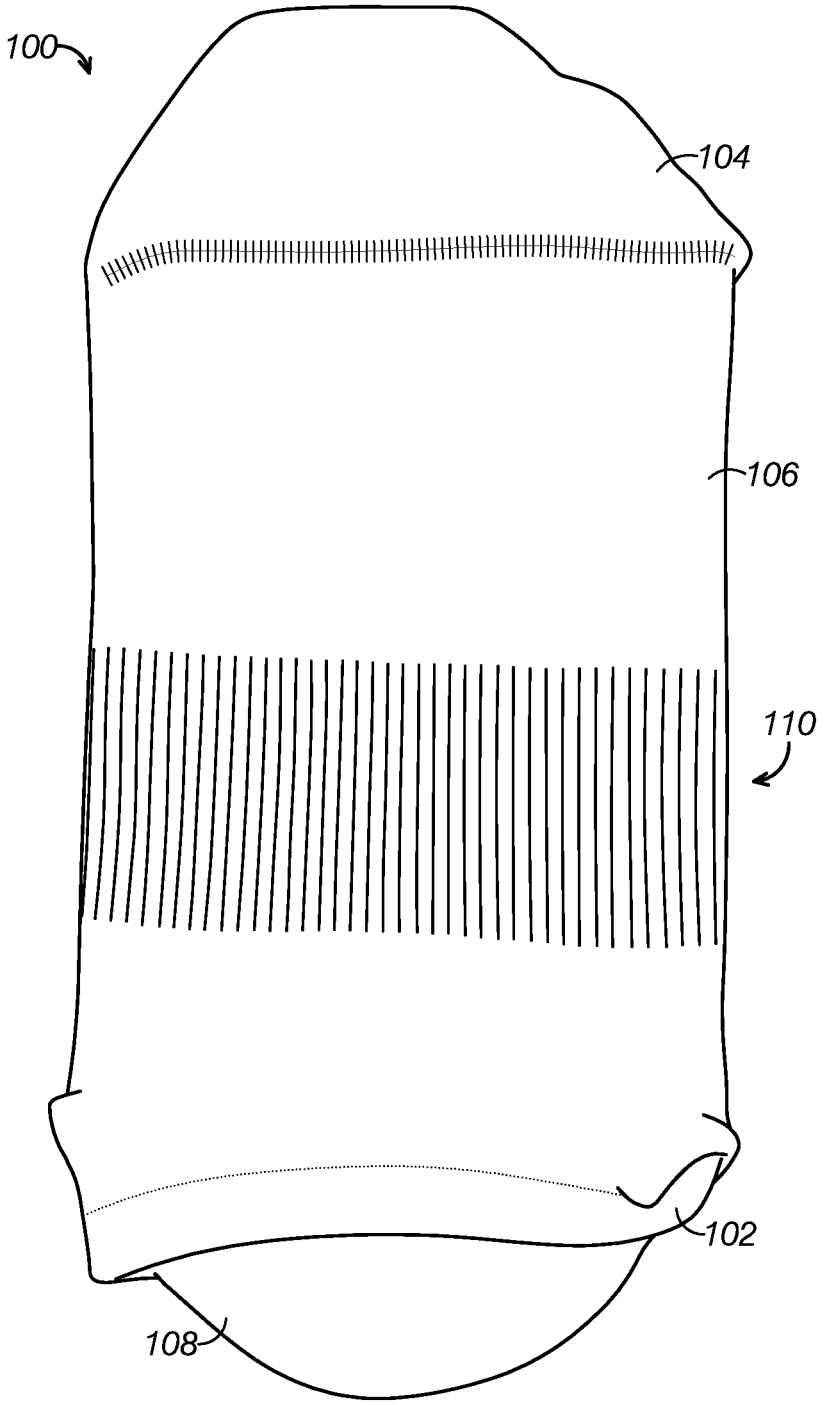
FIG. 1 is a top outside view of a first illustrative gripping sock in accordance with aspects of the present disclosure.

Various aspects and examples of socks having integrated gripping systems, as well as related methods, are described below and illustrated in the associated drawings. Unless otherwise specified, a gripping sock in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "medial," "lateral," "anterior," "posterior," and the like are intended to refer to anatomical directions corresponding to a human foot. For example, "medial" refers to a relative position disposed toward the center of the human body, while "lateral" refers to a relative position disposed away from the center of the human body. "Anterior" refers to a relative position closer to the toe of a wearer and "posterior" refers to a relative position closer to the heel of the wearer. In the absence of a wearer, the same directional terms may be used as if the article of footwear is being worn in its expected configuration.

The terms "top" and "bottom" are intended to refer to portions of the sock as it is worn by a human foot. "Top," or "dorsal," portions of the sock contact top portions of the foot when worn, and "bottom," or "plantar," portions of the sock contact the sole of the foot when worn.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

A "sock" or "stocking" is an article of apparel that covers portions of the foot and, in some examples, the lower leg. Socks may or may not have toe and/or heel portions, and may include portions covering only some (or none) of the toes.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a sock or stocking in accordance with the present teachings may include integrated gripping systems disposed on both an internal and an external surface of a sock (e.g., on a sole of the sock). The external gripping system and internal system may be out of register with each other, or otherwise non-aligned, and are engineered to apply varied gripping forces at different predetermined areas between a floor and the wearer's foot.

The external gripping system comprises a pattern of discrete external gripping surfaces, which may be flush with the external surface of the sock or may be raised. The pattern of external gripping surfaces may have any suitable shape, such as rectangular, circular, ovular, square, diamond-shaped, stadium-shaped, oblong, irregular, amorphous, star-shaped, and/or the like. In some examples, the external gripping surfaces each have a rounded profile, and comprise raised dots, bumps, pods, nodules, and/or the like comprising a first gripping material. In some examples, the pattern of external gripping surfaces comprises zones (e.g., stripes or strips) of knitted material, which are knitted with a gripping thread comprising a first gripping material. The first gripping material may comprise any suitable material configured to increase a coefficient of friction between the sole of the sock and the floor, such as silicone, polyurethane, synthetic and/or natural rubbers, and/or the like. In some examples, the first gripping material comprises natural fibers encapsulated in a polyurethane foam. In some examples, the first gripping material comprises a multifilament polyamide yarn having a silicone sheath (AKA a silicone-coated yarn). In some examples, the pattern of external gripping surfaces are disposed on a sole of the sock, as well as on portions of the sock corresponding to the sides of the foot, toes, heel of a wearer, and/or top of the foot of the wearer.

The internal gripping system comprises a pattern of discrete internal gripping surfaces, which may be flush with the internal surface of the sock or may be raised. The internal gripping surfaces may each have any suitable shape, such as rectangular, circular, ovular, square, diamond-shaped, stadium-shaped, oblong, irregular, amorphous, star-shaped, and/or the like. In some examples, the plurality of internal gripping surfaces may have a substantially flat profile, so as not to add bulk to the sock. In some examples, the pattern of internal gripping surfaces comprise dots, bumps, pods, nodules, and/or the like comprising a second gripping material. In some examples, the pattern of internal gripping surfaces comprise zones (e.g., stripes) of knitted material, which are knitted with a gripping yarn comprising a second gripping material. The second gripping material may comprise any suitable material configured to increase a coefficient of friction between the sole of the sock and the floor, such as silicone, polyurethane, synthetic and/or natural rubbers, and/or the like. In some examples, the second gripping material comprises natural fibers encapsulated in a polyurethane foam. In some examples, the second gripping material comprises a multifilament polyamide yarn having a silicone sheath (AKA a silicone-coated yarn). In some examples, the internal gripping system is disposed on surfaces of a sole of the sock, as well as portions of internal surfaces of the sock corresponding to the sides of the foot, toes, heel of a wearer and/or top of the foot of the wearer.

Gripping surfaces may be arranged such that the external gripping system and the internal gripping system collectively provide gripping force while reducing discomfort to a wearer. Accordingly, in some examples, the pattern of external gripping surfaces has a different density than the pattern of internal gripping surfaces, as measured by a number of the gripping surfaces per centimeter. In some examples, biomechanics testing is used to determine peak forces experienced by the external surfaces of the sock. The external gripping surfaces may be concentrated in areas that experience peak forces. In some examples, a density of the discrete external gripping surfaces is greater beneath a heel region and a ball-of-foot region of the knit sock than in other areas of the exterior surface.

The internal gripping system may include fewer and/or smaller gripping surfaces, which facilitates reduced contact between gripping material and the skin of a wearer. Similarly, the internal gripping system may include gripping surfaces disposed in areas of the sock corresponding to low-sensitivity and/or non-weight bearing areas of the foot. Accordingly, the internal gripping surfaces may be closer to a perimeter of the internal surface of the sock. In some examples, the second pattern of discrete internal gripping surfaces are disposed in a heel region of the knit sock. In some examples, the pattern of external gripping surfaces and the pattern of internal gripping surfaces are configured to improve traction by producing a shearing vector between foot-to-sock frictional forces and sock-to-underlying surface frictional forces.

The internal gripping surfaces may be out of registration and/or otherwise unaligned with the external gripping surfaces, which may decrease heat or discomfort experienced by the wearer. If present, areas of overlapping gripping material may be experienced by the wearer as "hot spots," due to heat generated by frictional forces. Alternating and/or offsetting internal and external gripping surfaces may allow for heat dissipation and sweat wicking by non-gripping areas of the sock. In some examples, there is no overlap between the internal gripping surfaces and the external gripping surfaces. In some examples, the pattern of discrete external gripping surfaces and the pattern of discrete internal gripping surfaces are mutually exclusive.

In general, a method of manufacturing a sock or stocking in accordance with the present teachings includes bonding the internal gripping material to an inner surface of the sock, and bonding the external gripping material to an outer surface of the sock. In some examples, a method of manufacturing a sock or stocking in accordance with the present teachings includes knitting the sock with a gripping yarn such that gripping material is disposed on both the inner surface of the sock and the outer surface of the sock.

Examples, Components, and Alternatives

The following sections describe selected aspects of illustrative gripping socks as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Gripping Sock

As shown in FIGS. 1-6, this section describes a first illustrative gripping sock (AKA stocking) 100. Sock 100 is an example of socks or stockings including integrated gripping systems, described above.

Figure 2:
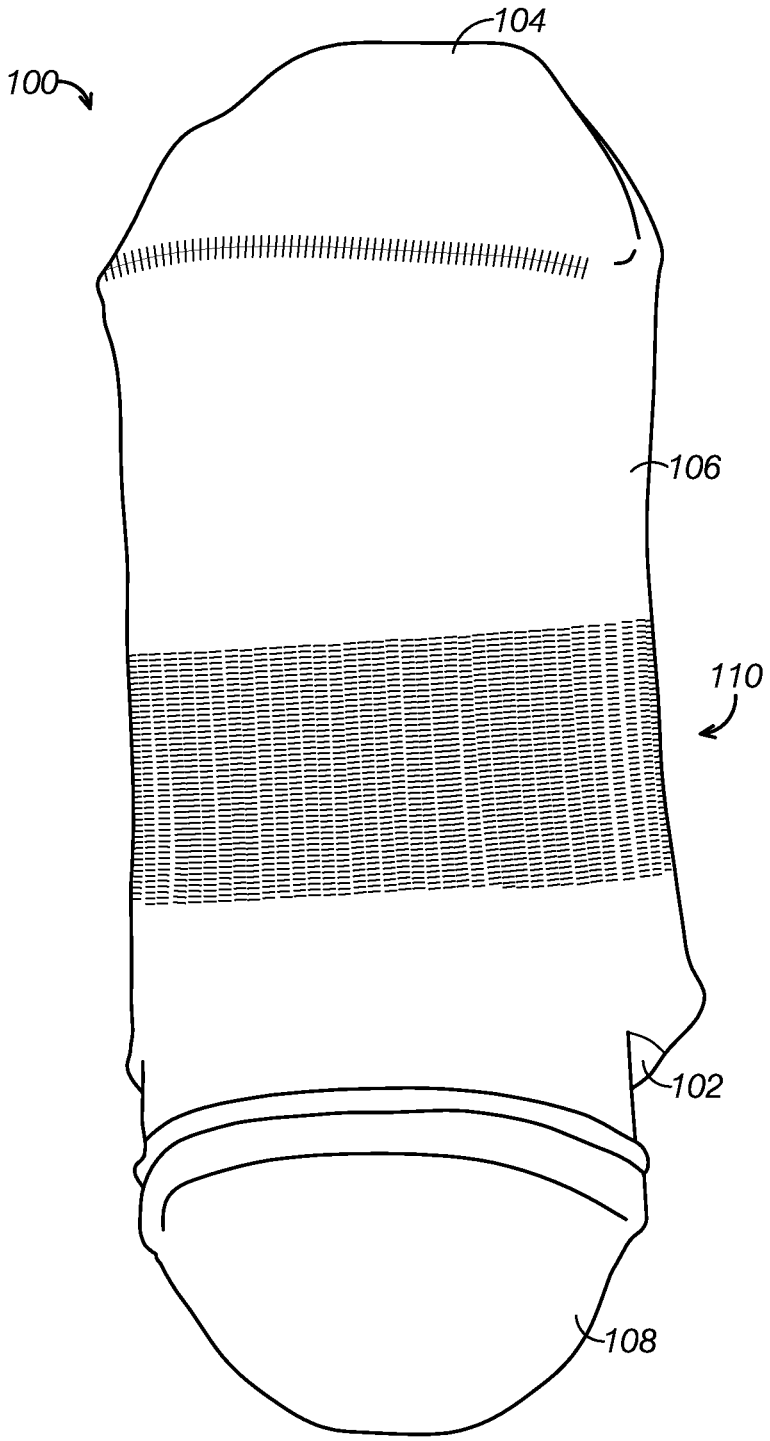
FIG. 2 is a top inside view of the gripping sock of FIG. 1.

As depicted in FIGS. 1 and 2, gripping sock 100 comprises a knit sock 110 including a heel region 102, a toe region 104, and a sock body 106 disposed between the heel region and the toe region. In some examples, knit sock 110 includes a heel tab 108 disposed above heel region 102. Knit sock 110 comprises an external "body yarn," an internal "plaiting yarn," and an elastic intertwined between the body and plaiting yarns. In some examples, sock 110 is knitted using a filament nylon as body yarn, spandex as plaiting yarn, and double covered elastic throughout the sock body. In some examples, sock 110 includes yarns comprising polyester, cotton, wool, acrylic, polypropylene, high density polyethylene, and/or the like. Knit sock 110 may be manufactured using any suitable method for making socks, such as knitting the sock using a circular knitting machine, knitting the sock using a flatbed knitting machine, cut-and-sew construction, weaving, and/or the like. In some examples, knit sock 110 is knit on a computerized circular knitting machine.

Gripping sock 100 includes gripping systems comprising gripping material coupled to inner and outer surfaces of the sock. In some examples, the gripping material is coupled to inner and outer surfaces of a sole 112 of the sock (see FIG. 3). Sole 112 is configured to contact the sole of a wearer's foot when worn. External gripping material 120 is bonded (e.g., using heat and/or pressure activated adhesive) to an outer surface 122 of knit sock 110. Internal gripping material 130 is bonded (e.g., using heat and/or pressure activated adhesive) to an inner surface 132 of knit sock 110. In some examples, the internal and external gripping material is applied to a sole of the sock, as well as to portions of the sock corresponding to the sides of the foot and heel of a wearer.

Figure 3:
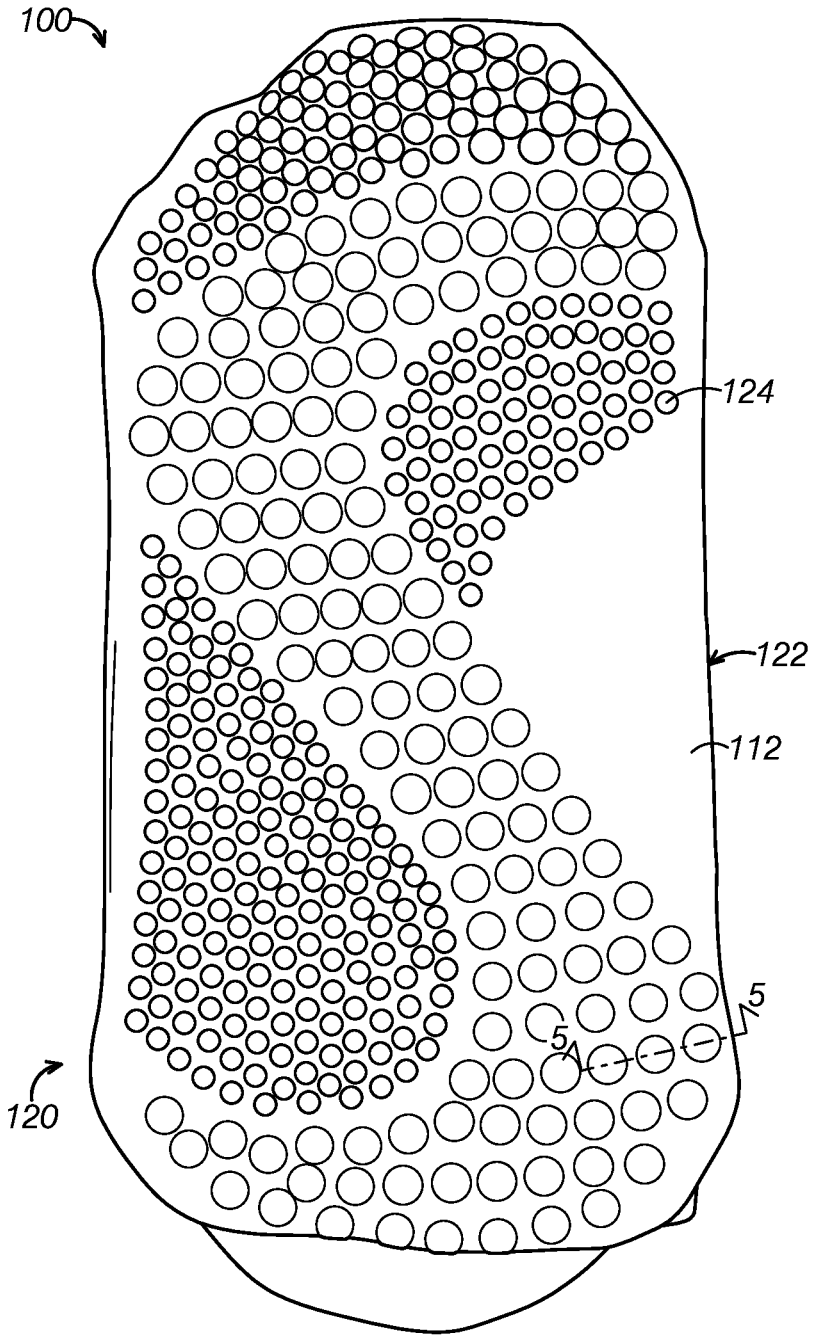
FIG. 3 is a bottom outside view of the gripping sock of FIG. 1.

As depicted in FIG. 3, external gripping system (AKA external gripping pattern) 120 comprises a plurality of gripping dots 124 forming gripping surfaces, applied at strategic locations to outer surface 122 of the sock. In some examples, gripping dots 124 have any suitable texture disposed on an outer surface, such as concentric circles, grooves, bumps, and/or the like. In some examples, gripping dots 124 are raised and have a substantially rounded outer surface, increasing an available surface area of the gripping dots when contacting the ground or other underlying surface. In some examples, gripping dots 124 are substantially flat. External, or "face," surfaces of the gripping dots may increase a coefficient of friction between the sock and the ground or other underlying surface in both wet and dry conditions. Internal, or "back," surfaces of the gripping dots may comprise an adhesive material configured to bond to the knit sock.

Gripping dots 124 may comprise any suitable external gripping material having high grabbing force. The external gripping material may also be selected for an ability to provide tactile comfort, moisture-wicking properties, sustainability, and/or the like. Gripping dots 124 may comprise any suitable gripping material configured to increase a coefficient of friction between the sole of the sock and the floor, such as silicone, polyurethane, synthetic and/or natural rubbers, and/or the like. In some examples, the external gripping material comprises natural fibers encapsulated in a polyurethane foam structure. This material provides an improved level of grip on wet surfaces when compared with silicone materials. External gripping system 120 is configured to provide improved grip and balance (in combination with the internal gripping system) when contacting a variety of flooring materials such as wood, concrete, workout mats, and/or the like. Accordingly, in some examples, different zones of gripping dots 124 comprise different gripping materials (e.g., some dots comprise natural fibers encapsulated in polyurethane foam and some dots comprise silicone) and/or different shapes and sizes of gripping surfaces 124.

Gripping dots 124 are arranged, for example, based on pressure mapping data and skin sensitivity data, thereby forming a number of different gripping zones engineered based on the pressure mapping data and skin sensitivity data. Arrangements of gripping dots 124 within the gripping zones are engineered based on plantar pressure, skin sensitivity, and traction requirements for different activities. Gripping dots 124 are arranged in higher concentrations in areas of the foot which experience highest pressure loads. In some examples, gripping dots 124 may be arranged in highest concentrations beneath the ball of a wearer's foot and the heel of a wearer's foot, and may be arranged in lower concentrations beneath a wearer's arch (as depicted in FIG. 3). In some examples, gripping dots 124 are arranged in a gradient from areas of highest concentration to areas of lowest concentration. In some examples, gripping dots 124 comprise raised circles of the external gripping material. In some examples, gripping dots 124 comprise any suitable shapes and/or size for improving traction, such as lines, triangles, rectangles, ovals, oblong shapes, amorphous shapes, and/or the like.

Figure 4:
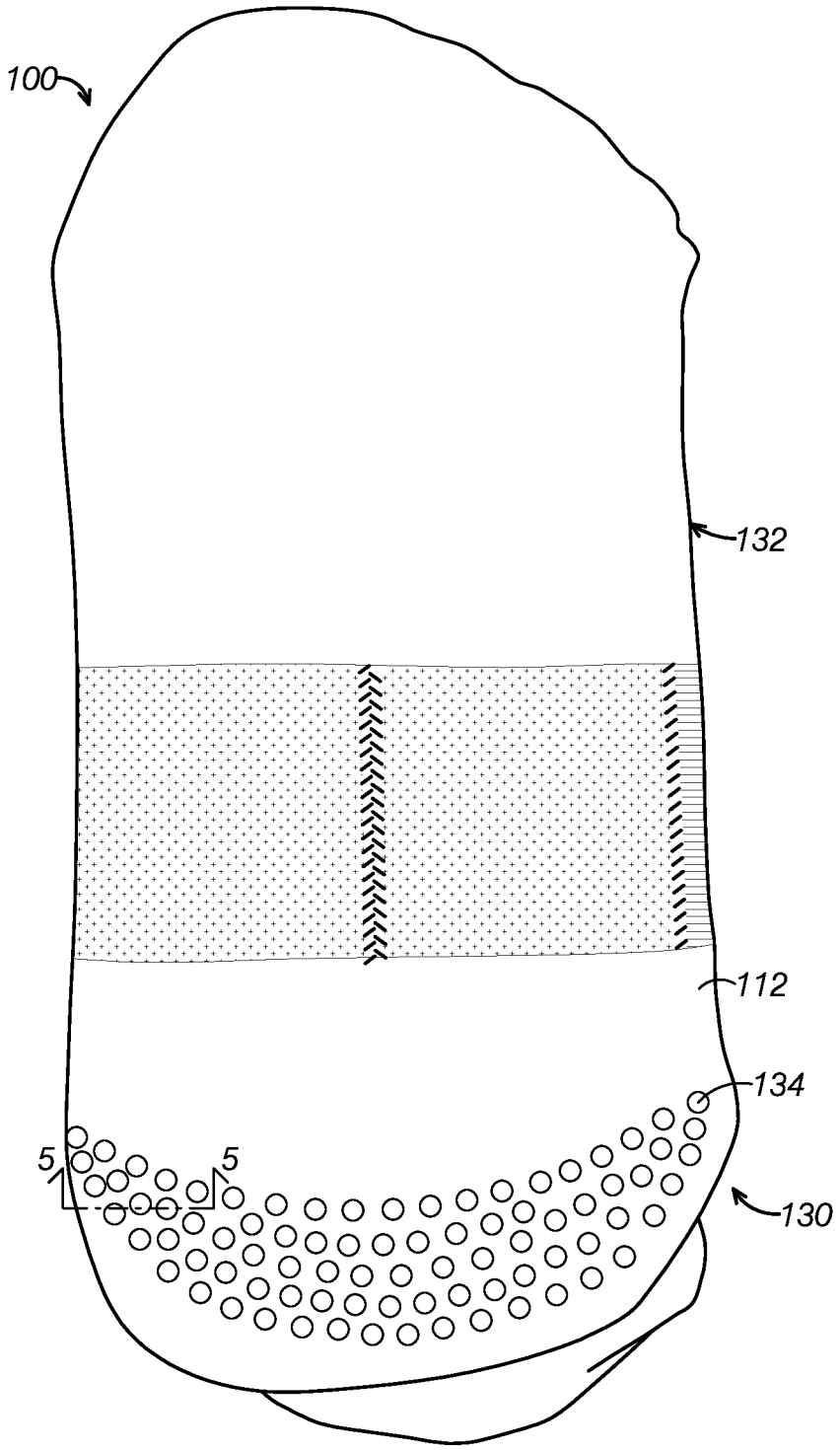
FIG. 4 is a bottom inside view of the gripping sock of FIG. 1.

Turning now to FIG. 4, internal gripping system (AKA internal gripping pattern) 130 comprises a plurality of gripping dots 134 forming gripping surfaces applied at strategic locations to inner surface 132 of the sock. In some examples, gripping dots 134 may be substantially flat so as not to add bulk to the sock. In some examples, gripping dots 124 are raised and have a substantially rounded outer surface, increasing an available surface area of the gripping dots when contacting the wearer's skin. Exposed, or "face," surfaces of the gripping dots may provide an increased coefficient of friction between the sock and the wearer's skin in both wet and dry conditions. Internal or "back," surfaces of the gripping dots may comprise an adhesive material configured to bond to the knit sock.

Gripping dots 134 may comprise any suitable internal gripping material having high grabbing force. The internal gripping material may also be selected for an ability to provide tactile comfort, moisture-wicking properties, sustainability, and/or the like. Gripping dots 134 may comprise any suitable gripping material configured to increase a coefficient of friction between the sole of the sock and the floor, such as silicone, polyurethane, synthetic and/or natural rubbers, and/or the like. In some examples, the internal gripping material comprises natural fibers encapsulated in a polyurethane foam structure. This material provides an improved level of grip on wet skin when compared with silicone materials. The internal gripping material is configured to provide grip to the skin surface without detracting from the sock's comfort. In some examples, different zones of gripping dots 134 comprise different gripping materials (e.g., some dots comprise natural fibers encapsulated in polyurethane foam and some dots comprise silicone) and/or different shapes and sizes of gripping surfaces 134.

Internal gripping dots 134 are arranged based on areas of the sock which are likely to pull away from the foot when a gripping force is applied between the floor and the external gripping material. In some examples, internal gripping dots 134 are disposed at the base of the heel, and prevent the sock from rolling off of the wearer's foot. In some examples, the internal gripping system is applied to internal surfaces of a sole of the sock, as well as portions of internal surfaces of the sock corresponding to the sides of the foot and heel of a wearer, and reduce slippage during lateral movement. In some examples, gripping dots 134 are arranged in a gradient from areas of highest concentration (e.g., beneath a wearer's heel) to areas of lowest concentration (e.g., beneath a wearer's arch). In some examples, gripping dots 134 comprise circles of gripping material. In some examples, gripping dots 134 comprise any suitable shapes for improving traction, such as lines, triangles, rectangles, ovals, oblong shapes, amorphous shapes, and/or the like.

Figure 5:
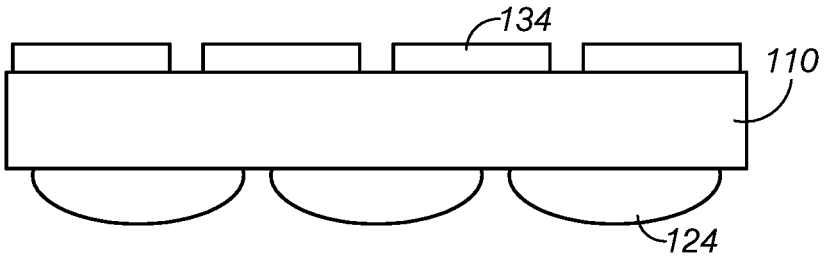
FIG. 5 is a schematic sectional view a sole of the gripping sock of FIG. 1.

FIG. 5 depicts a cross-sectional view of the sole of the sock. As is depicted in FIG. 5, the knit sock 110 is disposed between the external gripping system 120 and the internal gripping system 130. The external gripping system and internal gripping system work together to retain the foot within the sock. External gripping system 120 has a higher coefficient of friction with the floor than yarns used to knit the sock. A wearer applying force to the floor with their foot magnifies a grabbing force between external gripping system 120 and the floor. When force is applied between the floor and external gripping system 120, internal gripping system 130 produces a higher resultant grabbing force against the surface of the skin than knit sock 110 alone. Because the external gripping material is gripping the floor and the internal gripping material is gripping the foot, a wearer feels an improved sensation of balance. In the absence of the external gripping system, the wearer would slip against the floor. In the absence of the internal gripping system, the wearer's sock would slip against their skin.

The internal pattern of gripping dots 134 provides improved grip between the sock and the skin, which prevents slipping of the sock on the foot when external gripping system 120 engages with the floor or other underlying surface (e.g., mat, ground). In the absence of internal gripping dots 134, the sock would slip or roll off the foot as the frictional force between the floor and the sock would pull on the sock. Including both internal and external gripping surfaces in the sock allows each gripping system to provide optimal grip, stability, and balance without causing discomfort to the wearer or causing slippage. Specifically, the internal gripping surfaces are disposed and engineered in selected locations to retain the sock against the foot and prevent relative motion between the sock and the foot, but the internal gripping surfaces do not completely cover the internal surface of the sock, thereby allowing the knit sock to wick sweat from the foot of a wearer.

Gripping surfaces may be arranged such that the external gripping system and the internal gripping system collectively provide gripping force while reducing discomfort to a wearer. Accordingly, the internal gripping system may include fewer and/or smaller gripping surfaces, which facilitates reduced contact between gripping material and the skin of a wearer. Similarly, the internal gripping system may include gripping surfaces disposed in areas of the sock corresponding to low-sensitivity and/or non-weight bearing areas of the foot. In some examples, the internal gripping surfaces may be out of registration and/or otherwise unaligned with the external gripping surfaces, which may decrease heat or discomfort experienced by the wearer. Alternating and/or offsetting internal and external gripping surfaces may allow for heat dissipation and sweat wicking by non-gripping areas of the sock.

B. Second Illustrative Gripping Sock

As shown in FIGS. 6-9, this section describes a second illustrative gripping sock 200. Sock 200 is another example of socks or stockings including integrated gripping systems.

Gripping sock (AKA stocking) 200 comprises a knit sock 210 including a heel region 202, a toe region 204, and a sock body 206 disposed between the heel region and the toe region. In some examples, gripping sock 200 includes a leg 208 extending from heel region 202 in a transverse orientation to that of sock body 206. Knit sock 210 comprises a tube of knitted material, which includes an external "body yarn," an internal "plaiting yarn," and an elastic intertwined between the body and plaiting yarns. The body yarn and the plaiting yarn may be varied to produce internal and external gripping systems 220, 230 comprising zones of knitted gripping material (e.g., through the use of functional yarn).

Gripping sock 200 includes gripping systems comprising gripping material integrated within inner and outer surfaces of the sock. In some examples, the gripping systems are disposed on inner and outer surfaces of a sole 212 (see FIGS. 7 and 8). Sole 212 is configured to contact the sole of a wearer's foot when worn. External gripping system (AKA external gripping pattern) 220 includes knitted gripping courses disposed on an outer (AKA exterior) surface 222 of gripping sock 200. In some examples, the knitted gripping courses expose a functional yarn on the exterior surface of the sock. Internal gripping system (AKA internal gripping pattern) 230 includes knitted gripping courses disposed on an inner (AKA interior) surface of gripping sock 200. In some examples, the knitted gripping courses expose a functional yarn on the interior surface of the sock. In some examples, the internal and internal gripping systems may be disposed on a sole of the sock, as well as wrap around sides of the foot and heel of a wearer.

Figure 6:
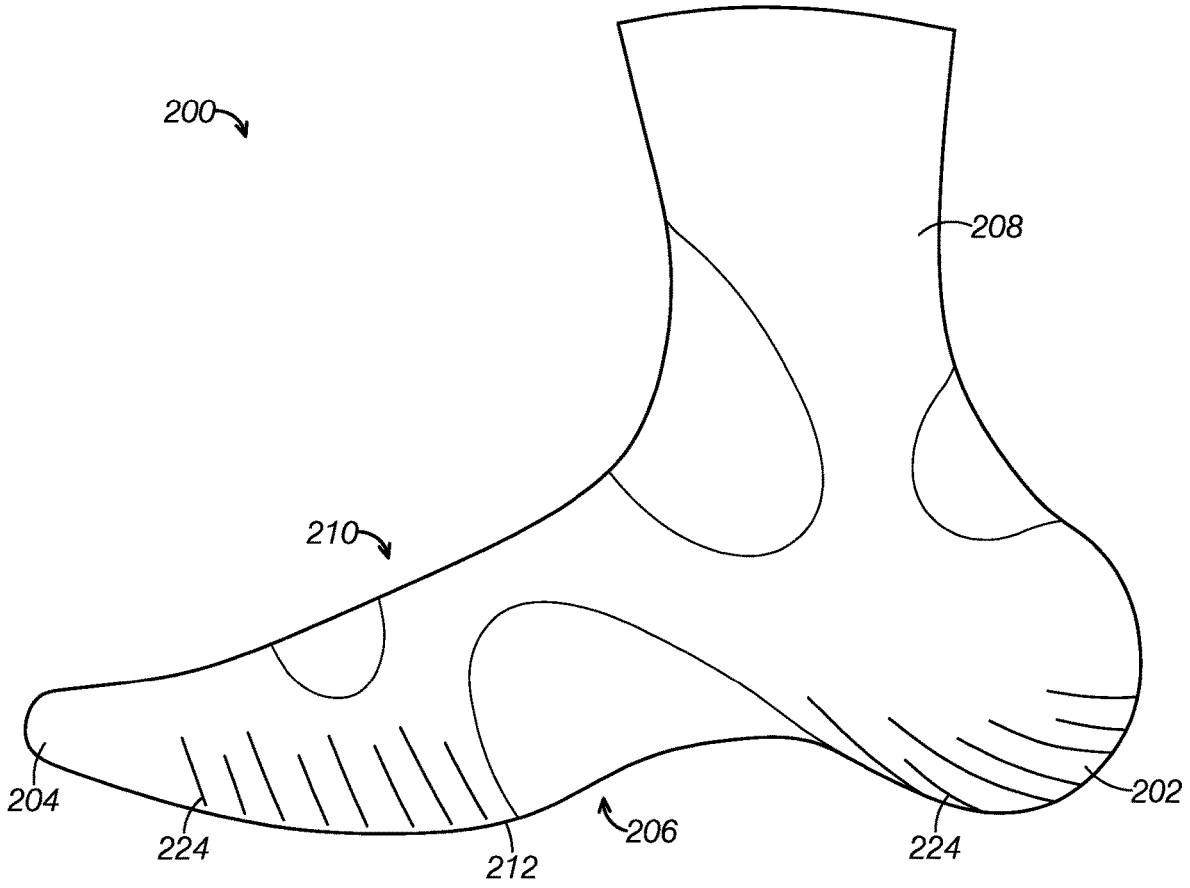
FIG. 6 is a side schematic view of a second illustrative gripping sock in accordance with aspects of the present disclosure.
Figure 7:
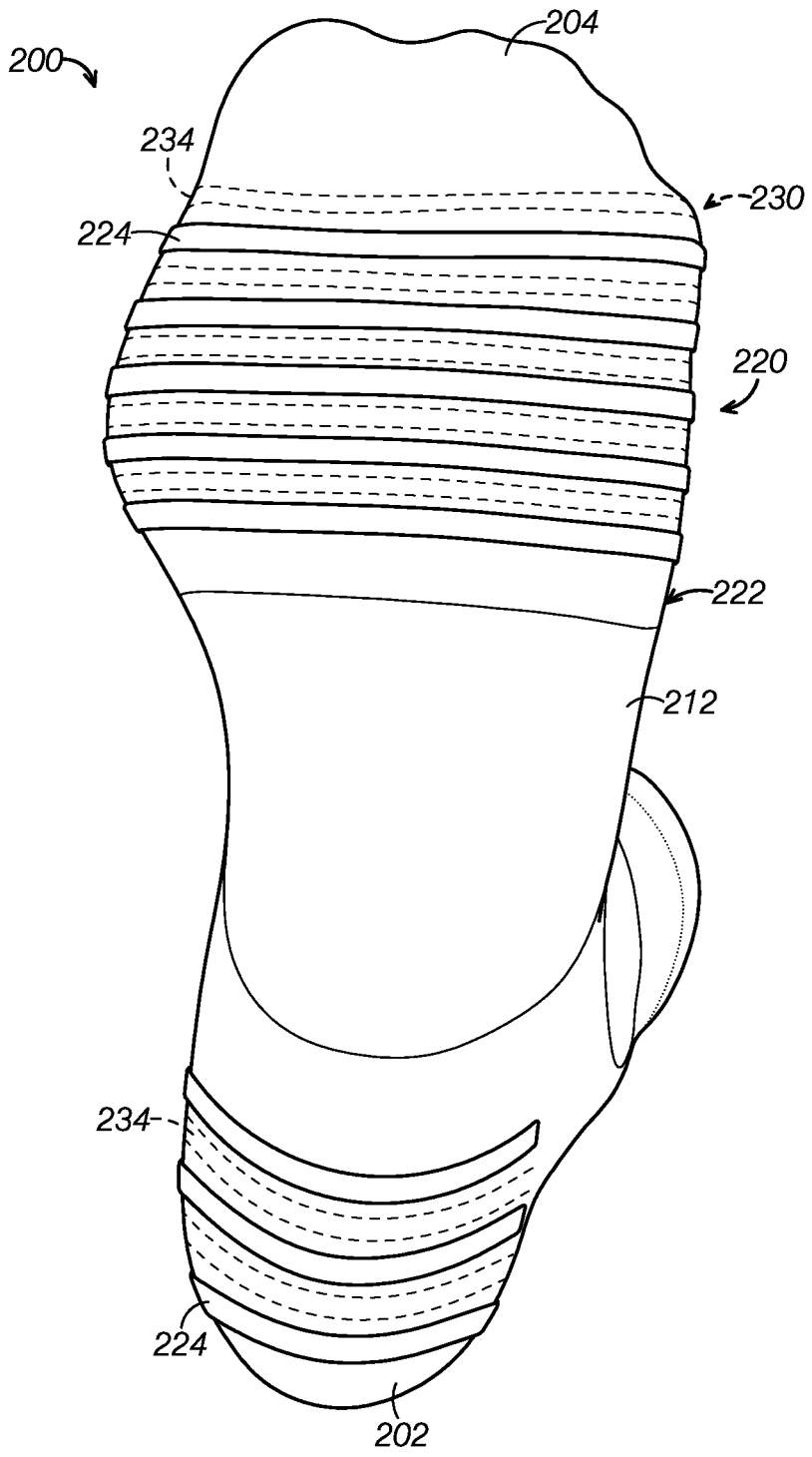
FIG. 7 is a bottom view of the gripping sock of FIG. 6.
Figure 8:
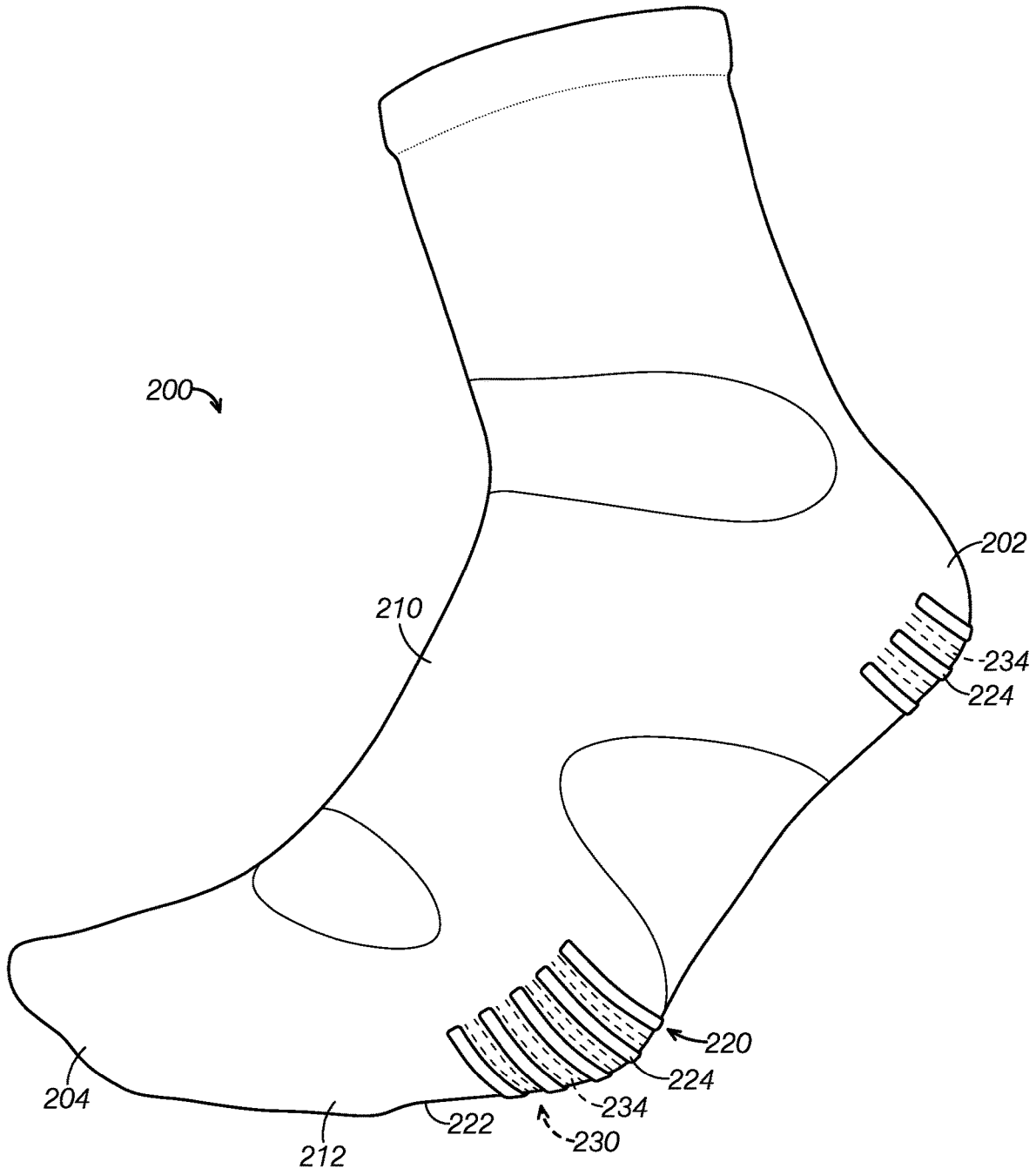
FIG. 8 is a side view of the gripping sock of FIG. 6.
Figure 9:
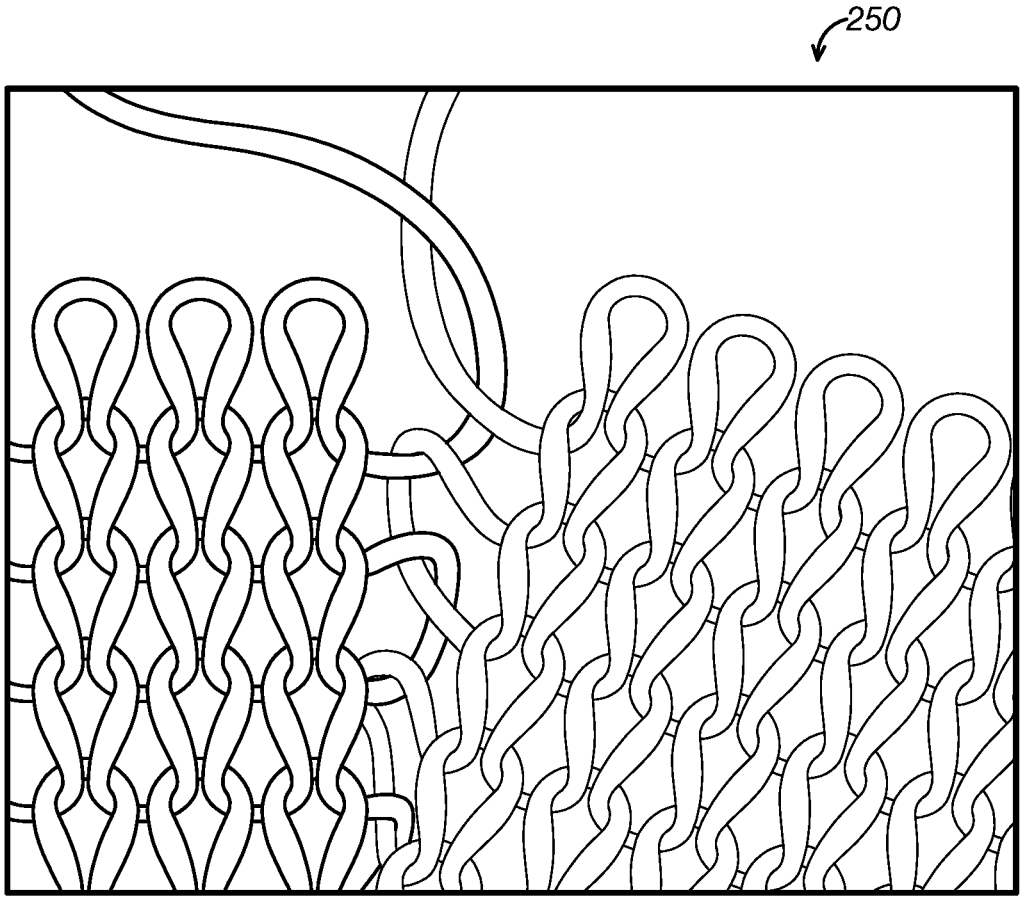
FIG. 9 is a schematic diagram of an illustrative intarsia knitting junction between fabric sections.

As depicted in FIGS. 6-8, external gripping system 220 comprises a plurality of laterally oriented gripping stripes 224 comprising courses of knitted gripping material, disposed at strategic locations on outer surface 222 of the sock. Stripes 224 may comprise outer courses of knitted material, which include at least one strand of yarn comprising a functional yarn (e.g., a gripping yarn). As described above, gripping sock 200 comprises a tube of knitted material including an external "body yarn," an internal "plaiting yarn," and an elastic intertwined between the body and plaiting yarns. Stripes 224 comprise outer courses of knitted material wherein at least one of the "body yarn" and the "plaiting yarn" comprise a gripping yarn. The gripping yarn may comprise any suitable material having high grabbing force, such as silicone, polyurethane, synthetic and/or natural rubbers, and/or the like. In some examples, the gripping yarn comprises a multifilament polyamide yarn having a silicone sheath. In some examples, the body yarn and/or the plaiting yarn comprise polyester, cotton, wool, acrylic, polypropylene, high density polyethylene, and/or the like. In some examples, the body yarn comprises filament nylon.

External gripping system 220 is configured to provide improved grip and balance (in combination with the internal gripping system) when contacting a variety of flooring materials such as wood, concrete, workout mats, and/or the like. Accordingly, in some examples, different zones of gripping stripes 224 comprise different gripping materials (e.g., some stripes comprise polyurethane yarn and some stripes comprise silicone) and/or different shapes and sizes of gripping stripes 224.

Gripping stripes 224 are arranged, for example, based on pressure mapping data and skin sensitivity data, thereby forming a number of different gripping zones engineered based on the pressure mapping data and skin sensitivity data. Arrangements of gripping stripes 224 within the gripping zones are engineered based on plantar pressure, skin sensitivity, and traction requirements for different activities. Gripping stripes 224 are disposed in higher concentrations in areas of the foot which experience highest pressure loads. In some examples, gripping stripes 224 may be arranged in highest concentrations beneath the ball of a wearer's foot (as depicted in FIGS. 6-8). In some examples, gripping stripes 234 may wrap around the sides of a wearer's foot. In some examples, gripping stripes 224 may be combined with gripping dots as described above with respect to gripping socks 100.

Turning now to FIGS. 7 and 8, internal gripping system 230 comprises a plurality of gripping stripes 234 comprising courses of knitted gripping material, disposed at strategic locations on an inner surface of the sock. Stripes 234 may comprise inner courses of knitted material, which include at least one strand of yarn comprising a gripping yarn. Stripes 234 comprise inner courses of knitted material, wherein at least one of the "body yarn" and the "plaiting yarn" of the knitted material comprise a gripping yarn. The gripping yarn may comprise any suitable material having high grabbing force, such as silicone, polyurethane, synthetic and/or natural rubbers, and/or the like. In some examples, the gripping yarn comprises a multifilament polyamide yarn having a silicone sheath. In some examples, the body yarn and/or the plaiting yarn may comprise polyester, cotton, wool, acrylic, polypropylene, high density polyethylene, and/or the like. In some examples, the body yarn comprises filament nylon. Internal gripping system 230 is configured to provide grip to the skin surface without detracting from the sock's comfort. In some examples, different zones of gripping stripes 234 comprise different gripping materials (e.g., some stripes comprise polyurethane yarn and some stripes comprise silicone) and/or different shapes and sizes of gripping stripes 234.

Internal gripping stripes 234 are arranged based on areas of the sock which are likely to pull away from the foot when a gripping force is applied between the floor and the external gripping material. In some examples, internal gripping stripes 234 alternate with external gripping stripes disposed beneath the ball of the foot of a wearer, and prevent the sock from rolling off of the wearer's foot. In some examples, the internal gripping system is disposed on internal surfaces of a sole of the sock, as well as portions of internal surfaces of the sock corresponding to the sides of the foot, and reduce slippage during lateral movement. In some examples, gripping stripes 234 may be combined with gripping dots as described above with respect to gripping socks 100.

External gripping system 220 and internal gripping system 230 work together to retain the foot within the sock. External gripping system 220 has a higher coefficient of friction with the floor than portions of the sock knitted without gripping yarn within outer courses of the knitted material. A wearer applying force to the floor with their foot magnifies a grabbing force between external gripping system 220 and the floor. When force is applied between the floor and external gripping system 220, internal gripping system 230 produces a higher resultant grabbing force against the surface of the skin than portions of the sock knitted without gripping yarn within inner courses of the knitted material. Because the external gripping material is gripping the floor and the internal gripping material is gripping the foot, a wearer feels an improved sensation of balance. In the absence of the external gripping system, the wearer would slip against the floor. In the absence of the internal gripping system, the wearer's sock would slip against their skin.

The internal pattern of gripping stripes 234 provides improved grip between the sock and the skin, which prevents slipping of the sock on the foot when external gripping system 220 engages with the floor or other underlying surface (e.g., mat, ground). In the absence of internal gripping stripes 234, the sock would slip or roll off the foot as the frictional force between the floor and the sock would pull on the sock. Including both internal and external gripping systems in the sock allows each gripping system to provide optimal grip, stability, and balance without becoming uncomfortable for the wearer or causing slippage. Specifically, the internal gripping stripes are disposed and engineered in critical locations to retain the sock against the foot and prevent relative motion between the sock and the foot, but do not completely cover the internal surface of the sock, thereby allowing the knit sock to wick sweat from the foot of a wearer.

Gripping stripes may be arranged such that the external gripping system and the internal gripping system collectively provide gripping force while reducing discomfort to a wearer. Controlling relative numbers and sizes of internal gripping stripes compared to the external gripping stripes may allow for tailoring of grip capabilities and the inclusion of localized grip areas within the sock. Accordingly, the internal gripping system may include fewer and/or smaller gripping stripes, which facilitates reduced contact between gripping material and the skin of a wearer. For example, internal gripping stripes 234 may be thinner than external gripping stripes 224 (see FIGS. 7 and 8). Similarly, the internal gripping system may include gripping surfaces disposed in areas of the sock corresponding to low-sensitivity and/or non-weight bearing areas of the foot. In some examples, the internal gripping surfaces may be out of registration and/or otherwise unaligned with the external gripping surfaces, which may decrease heat or discomfort experienced by the wearer. Areas of overlapping gripping material may be experienced by the wearer as "hot spots," due to heat generated by frictional forces. Silicone yarns may have insulating properties, which may interfere with heat and sweat dissipation. Accordingly, in some examples, the internal gripping stripes and the external gripping stripes may alternate, such that the gripping stripes do not overlap at any point. Alternating and/or offsetting internal and external gripping surfaces may allow for heat dissipation and sweat wicking by non-gripping areas of the sock. In some examples, internal and external gripping stripes may be separated by non-gripping stripes of knitted material, which may entirely consist of non-gripping yarn. The non-gripping yarn may comprise any suitable fiber, such as comprise polyester, cotton, wool, acrylic, polypropylene, high density polyethylene, and/or the like.

Gripping sock 200 may be manufactured using any suitable method for making socks, such as knitting the sock using a circular knitting machine, knitting the sock using a flatbed knitting machine, cut-and-sew construction, weaving, and/or the like. In some examples, gripping sock 200 is knitted on a computerized circular knitting machine.

Gripping yarns, such as silicone yarns, may be comparatively difficult to knit with circular knitting machines when compared with non-gripping yarns because of elasticity and/or increased traction between the gripping yarns and needles of the computerized knitting machine (when compared with flatbed knitting machines). Accordingly, in examples wherein gripping sock 200 is knitted on a computerized circular knitting machine, the sock may be knitted in alternating segments extending along a long axis of the sock. For example, gripping yarn may be disposed only in a sole of the gripping sock, or may wrap only partially around the wearer's foot. Knitting the sock in segments may reduce frictional force between the yarn and the needles, as the yarn may experience less inward force during knitting.

Gripping yarns may also be difficult to knit with conventional knitting methods, as conventional knitting machines leave tails of cut yarn between knitted segments comprising different yarns. Gripping yarns may easily pull out of this kind of knitted fabric, due to increased grabbing force between the yarn and a wearer's skin. Accordingly, intarsia knitting may be utilized to produce a seamless transition between gripping segments and non-gripping segments. Intarsia knitting interlocks yarn tails of adjacent segments, reducing cut yarn ends within a knitted material (see intarsia knit material 250 of FIG. 9).

Accordingly, gripping sock 200 may comprise two or more alternating knitted segments extending along a long axis of the sock, at least one of which includes gripping yarn, and at least one of which does not include gripping yarn. In some examples, at least one of the gripping segments is disposed in a sole of the sock. The gripping yarn segments may extend laterally only partway around the sock (e.g., only on a lower portion), transitioning to another knitted segment not including the gripping yarn. Any or all of these knitted segments may transition or be joined together using intarsia knitting, and may accordingly have interlocked yarn tails between the knitted segments.

C. Third Illustrative Gripping Sock

Figure 10:
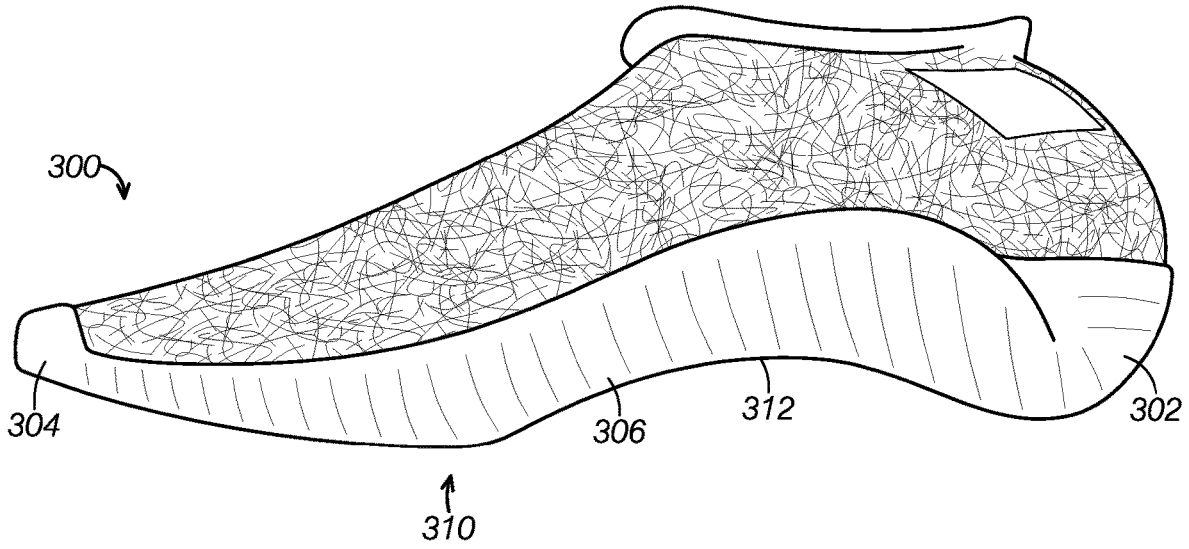
FIG. 10 is a side schematic view of a third illustrative gripping sock in accordance with aspects of the present disclosure.
Figure 11:
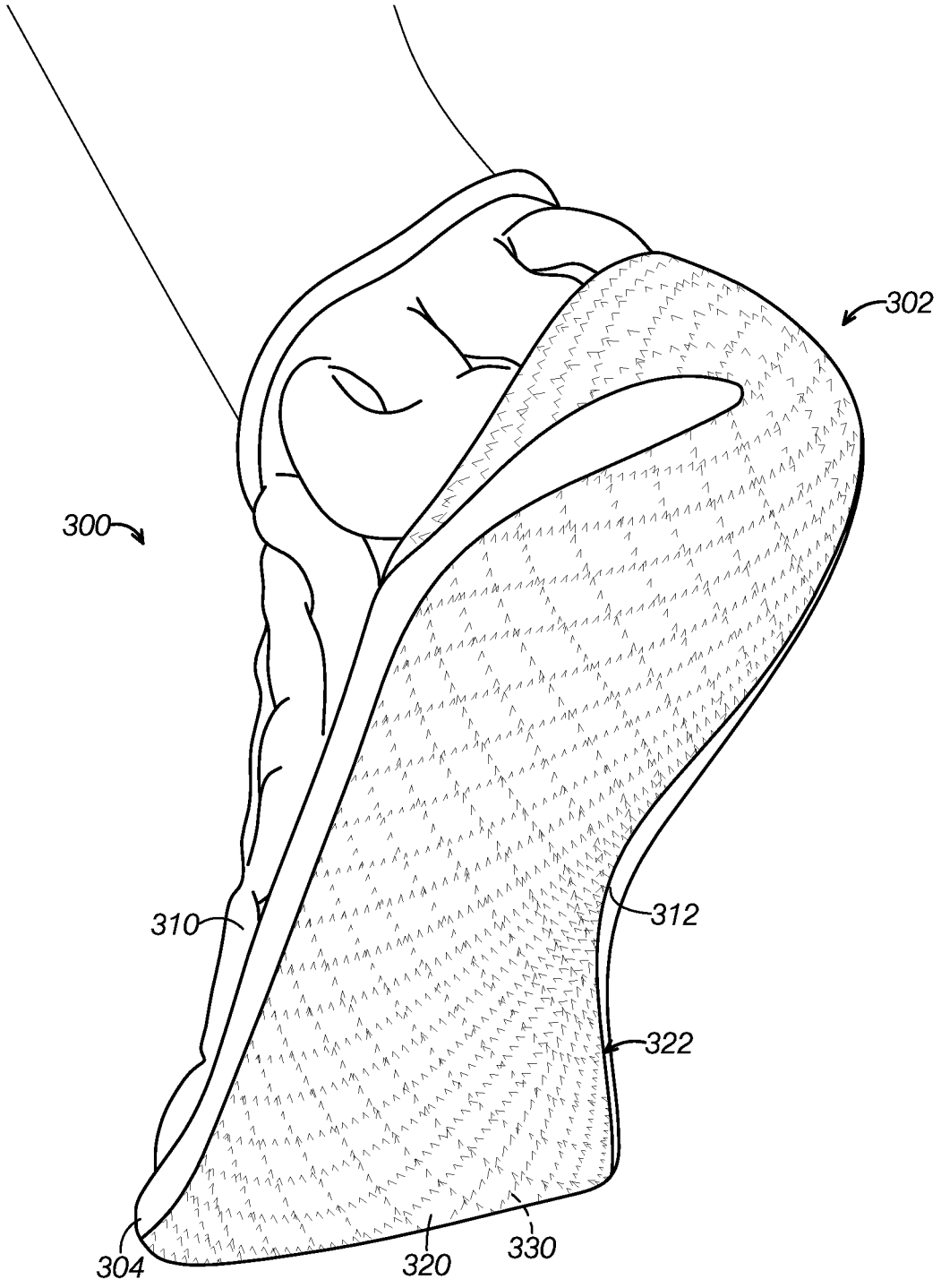
FIG. 11 is a bottom isometric view of the gripping sock of FIG. 10.
Figure 12:
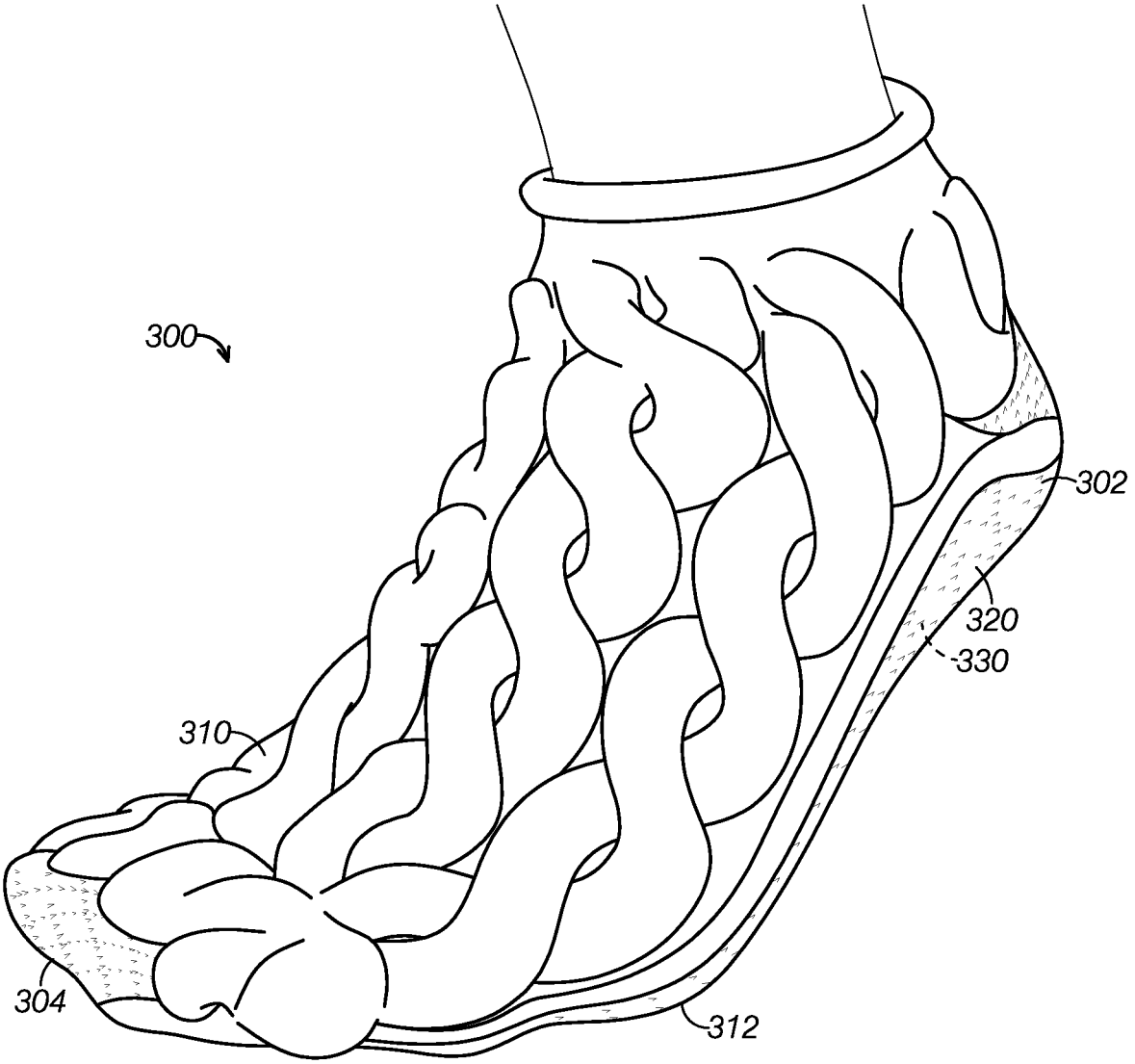
FIG. 12 is a side view of the gripping sock of FIG. 10.

As shown in FIGS. 10-12, this section describes a third illustrative gripping sock 300. Sock 300 is an example of socks or stockings including integrated gripping systems, described above.

Gripping sock (AKA stocking) 300 comprises a knit sock 310 including a heel region 302, a toe region 304, and a sock body 306 disposed between the heel region and the toe region. Knit sock 310 comprises a tube of knitted material, which includes an external "body yarn," an internal "plaiting yarn," and an elastic intertwined between the body and plaiting yarns. The body yarn and the plaiting yarn may be varied to produce external and internal gripping systems 320, 330 comprising alternating patterns of knitted gripping material.

Gripping sock 300 includes gripping systems comprising gripping material integrated within inner and outer surface of the sock. In some examples, the gripping systems are disposed on inner and outer surfaces of a sole 312 (see FIG. 11). Sole 312 is configured to contact the sole of a wearer's foot when worn. External gripping system (AKA external gripping pattern) 320 includes knitted gripping stitches disposed on an outer (AKA external) surface 322 of gripping sock 300. In some examples, the knitted gripping stitches expose a functional yarn on the exterior surface of the sock. Internal gripping system (AKA internal gripping pattern) 330 includes knitted gripping stitches disposed on an inner (AKA internal) surface of gripping sock 300. In some examples, the knitted gripping stitches expose a functional yarn on the interior surface of the sock. In some examples, the external and internal gripping systems may be disposed on a sole of the sock, as well as wrap around sides of the foot and heel of a wearer.

As depicted in FIGS. 10-12, external gripping system 320 and internal gripping system 330 comprise alternating patterns of knitted material. The internal gripping system is an inversion of the pattern of the external gripping system. Accordingly, if a stitch disposed on an outer surface of sole 312 comprises a gripping stitch, a corresponding stitch disposed on an inner surface of the sole comprises a non-gripping stitch. Gripping stitches included within the external and internal gripping systems are configured such that gripping stitches are disposed at strategic locations within the inside and outside of the sock. Gripping stitches are knitted from yarn including at least one strand comprising a functional yarn (AKA a gripping yarn). As described above, gripping sock 300 comprises a tube of knitted material including an external "body yarn," an internal "plaiting yarn," and an elastic intertwined between the body and plaiting yarns. External gripping system 320 comprises outer gripping stitches of knitted material wherein at least one of the "body yarn" and the "plaiting yarn" comprise a gripping yarn. Similarly, internal gripping system 330 comprises inner gripping stitches of knitted material wherein at least one of the "body yarn" and the "plaiting yarn" comprise a gripping yarn. The gripping yarn may comprise any suitable material having high grabbing force, such as silicone, polyurethane, synthetic and/or natural rubbers, and/or the like. In some examples, the gripping yarn comprises a multifilament polyamide yarn having a silicone sheath. In some examples, one or more of the body yarn and the plaiting yarn may comprise polyester, cotton, wool, acrylic, polypropylene, high density polyethylene, and/or the like. External gripping system 320 is configured to provide improved grip and balance (in combination with the internal gripping system) when contacting a variety of flooring materials such as wood, concrete, workout mats, and/or the like. Internal gripping system 330 is configured to provide grip to the skin surface without detracting from the sock's comfort.

Stitches of external gripping system 320 and internal gripping system 320 are arranged, for example, based on pressure mapping data and skin sensitivity data, thereby forming a knitting pattern engineered based on the pressure mapping data and skin sensitivity data. The knitting pattern is engineered based on plantar pressure, skin sensitivity, and traction requirements for different activities. Stitches of external gripping system 320 are disposed in higher concentrations in areas of the foot which experience highest pressure loads. In some examples, stitches of external gripping system 320 may be arranged in highest concentrations beneath the ball of a wearer's foot. In some examples, external gripping system 320 may wrap around the sides of a wearer's foot. In some examples, external gripping system 320 may be combined with gripping dots as described above with respect to gripping socks 100.

Similarly, stitches of internal gripping system 330 are disposed in areas of the sock which are likely to pull away from the foot when a gripping force is applied between the floor and the external gripping material. In some examples, internal gripping stitches alternate with external gripping stitches in areas of the sock disposed beneath the ball of the foot of a wearer, and prevent the sock from rolling off of the wearer's foot. In some examples, stitches of the internal gripping system are disposed on internal surfaces of a sole of the sock, as well as portions of internal surfaces of the sock corresponding to the sides of the foot, and reduce slippage during lateral movement. In some examples, the internal gripping system may be combined with gripping dots as described above with respect to gripping socks 100.

External gripping system 320 and internal gripping system 330 work together to retain the foot within the sock. External gripping system 320 has a higher coefficient of friction with the floor than portions of the sock knitted without gripping yarn within outer stitches of the knitted material. A wearer applying force to the floor with their foot magnifies a grabbing force between external gripping system 320 and the floor. When force is applied between the floor and external gripping system 320, internal gripping system 330 produces a higher resultant grabbing force against the surface of the skin than portions of the sock knitted without gripping yarn within inner stitches of the knitted material. Because the external gripping material is gripping the floor and the internal gripping material is gripping the foot, a wearer feels an improved sensation of balance. In the absence of the external gripping system, the wearer would slip against the floor. In the absence of the internal gripping system, the wearer's sock would slip against their skin.

Internal gripping system 330 provides improved grip between the sock and the skin, which prevents slipping of the sock on the foot when external gripping system 320 engages with the floor or other underlying surface (e.g., mat, ground). In the absence of internal gripping system 330, the sock would slip or roll off the foot as the frictional force between the floor and the sock would pull on the sock. Including both internal and external gripping systems in the sock allows each gripping system to provide optimal grip, stability, and balance without becoming uncomfortable for the wearer or causing slippage. Specifically, stitches of the internal gripping system are disposed and engineered in critical locations to retain the sock against the foot and prevent relative motion between the sock and the foot, but the internal gripping system does not completely cover the internal surface of the sock, thereby allowing the knit sock to wick sweat from the foot of a wearer.

The external and internal gripping systems may be configured to collectively provide gripping force while reducing discomfort to a wearer. Controlling relative numbers and locations of stitches of the external gripping system compared to stitches of the internal gripping system may allow for tailoring of grip capabilities and the inclusion of localized grip areas within the sock. As the internal gripping system is an inversion of the external gripping system, different textures and patterns of the sole of the gripping sock result in socks having different amount of inside grip vs. outside grip. Accordingly, the internal gripping system may include fewer gripping stitches than the external gripping system, which facilitates reduced contact between gripping material and the skin of a wearer. Similarly, the internal gripping system may include gripping surfaces disposed in areas of the sock corresponding to low-sensitivity and/or non-weight bearing areas of the foot.

Socks including areas of overlapping gripping material may be experienced by the wearer as "hot spots," due to heat generated by frictional forces. Silicone yarns may have insulating properties, which may interfere with heat and sweat dissipation. Accordingly, the internal gripping system and the external gripping system alternate, such that the gripping stripes do not overlap. Alternating and/or offsetting internal and external gripping surfaces may allow for heat dissipation and sweat wicking by non-gripping areas of the sock. In some examples, the internal and external gripping system may be discontinuous, and gripping regions may be separated from each other by non-gripping stripes of knitted material, which comprise non-gripping yarn.

As described above with respect to gripping sock 200, gripping sock 300 may be manufactured using any suitable method for making socks, such as knitting the sock using a circular knitting machine, knitting the sock using a flatbed knitting machine, cut-and-sew construction, weaving, and/or the like. In some examples, gripping sock 300 is knitted on a computerized circular knitting machine.

Accordingly, gripping sock 300 may comprise two or more alternating knitted segments extending along a long axis of the sock, at least one of which includes gripping yarn, and at least one of which does not include gripping yarn. In some examples, at least one of the gripping segments is disposed in a sole of the sock. The knitted segments may be joined together using intarsia knitting, and may accordingly have interlocked yarn tails between the knitted segments. In some examples, the non-gripping segments of the sock may comprise a textured knitting material, such as cable knit.

D. First Illustrative Manufacturing Method

Figure 13:
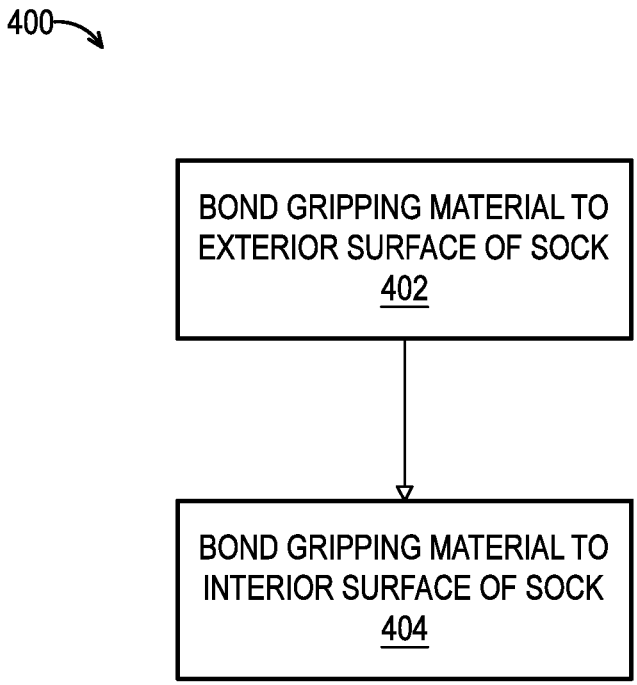
FIG. 13 is a flow chart depicting steps of a first illustrative method for manufacturing gripping socks in accordance with the present teachings.

This section describes steps of an illustrative method 400 for manufacturing socks including integrated internal and external gripping systems in accordance with the present teachings; see FIG. 13. Aspects of gripping sock 100 may be utilized in the method steps described below. Where appropriate, reference may be made to components and systems that may be used in carrying out each step. These references are for illustration, and are not intended to limit the possible ways of carrying out any particular step of the method.

FIG. 13 is a flowchart illustrating steps performed in an illustrative method, and may not recite the complete process or all steps of the method. Although various steps of method 400 are described below and depicted in FIG. 13, the steps need not necessarily all be performed, and in some cases may be performed simultaneously or in a different order than the order shown.

Step 402 of method 400 includes bonding a first gripping material to an exterior surface of a knit sock. In some examples, bonding the first gripping material to the sock includes applying any suitable adhesive to an interior surface of first gripping dots comprising a gripping material. In some examples, the adhesive comprises any suitable substance for bonding two components, such as heat-activated adhesive, pressure-activated adhesive, adhesive tapes, and/or the like. In some examples, bonding the first gripping material to the sock includes injection molding the first gripping material onto the knit sock. In some examples, bonding the first gripping material to the sock includes screen printing the first gripping material onto the knit sock. In some examples, the first gripping dots comprise raised, substantially hemispherical or semispherical dots of gripping material having a high coefficient of friction with smooth surfaces. The first gripping dots may comprise any suitable material configured to increase a coefficient of friction between the sock and the floor, such as silicone, polyurethane, synthetic and/or natural rubbers, and/or the like. In some examples, the first gripping dots comprise natural fibers encapsulated in a polyurethane foam structure. In some examples, the first gripping dots comprise any suitable shapes and/or size for improving traction, such as lines, triangles, rectangles, ovals, oblong shapes, amorphous shapes, and/or the like.

In some examples, bonding a first gripping material includes bonding first gripping dots to specific regions of the sole of the sock in a specific pattern. In some examples, the first gripping dots are bonded to regions of the sock which experience highest degrees of pressure when the sock is in use. The first gripping dots may be arranged, for example, based on pressure mapping data and skin sensitivity data, thereby forming a number of different gripping zones engineered based on the pressure mapping data and skin sensitivity data. Arrangements of first gripping dots within the gripping zones may be engineered based on plantar pressure, skin sensitivity, and traction requirements for different activities. The first gripping dots may be arranged in higher concentrations in areas of the foot which experience highest pressure loads. In some examples, the first gripping dots are arranged in highest concentrations beneath the ball of a wearer's foot and the heel of a wearer's foot, and are arranged in lower concentrations beneath a wearer's arch. In some examples, the first gripping dots are arranged in a gradient from areas of highest concentration to areas of lowest concentration.

Step 404 of method 400 includes bonding a second gripping material to an interior surface of a knit sock. In some examples, bonding the second gripping material to the sock includes applying any suitable adhesive to an interior surface of second gripping dots comprising a gripping material. In some examples, the adhesive comprises any suitable substance for bonding two components, such as heat-activated adhesive, pressure-activated adhesive, adhesive tapes, and/or the like. In some examples, bonding the second gripping material to the sock includes injection molding the second gripping material onto the knit sock. In some examples, bonding the second gripping material to the sock includes screen printing the second gripping material onto the knit sock. In some examples, the second gripping dots comprise flat, substantially circular dots of gripping material having a high coefficient of friction with skin. The second gripping material may comprise any suitable material configured to increase a coefficient of friction between the sock and the skin of a wearer, such as silicone, polyurethane, synthetic and/or natural rubbers, and/or the like. In some examples, the second gripping dots comprise natural fibers encapsulated in a polyurethane foam structure. In some examples, the second gripping dots comprise any suitable shapes for improving traction, such as lines, triangles, rectangles, ovals, oblong shapes, amorphous shapes, and/or the like.

In some examples, bonding a gripping material includes bonding gripping dots to specific regions of the sock which are likely to slip when the sock is in use. In some examples, the second gripping dots are bonded to targeted locations, thereby leaving large portions of the interior of the knit sock free to contact the skin of the wearer. The second gripping dots may be arranged, for example, based on areas of the sock which are likely to pull away from the foot when a gripping force is applied between the floor and the external gripping material. In some examples, the second gripping dots are disposed at the base of the heel, and prevent the sock from rolling off of the wearer's foot. In some examples, the second gripping dots are applied to internal surfaces of a sole of the sock, as well as portions of internal surfaces of the sock corresponding to the sides of the foot and heel of a wearer, and reduce slippage during lateral movement. In some examples, the second gripping dots are arranged in a gradient from areas of highest concentration (e.g., beneath a wearer's heel) to areas of lowest concentration (e.g., beneath a wearer's arch).

E. Second Illustrative Manufacturing Method

Figure 14:
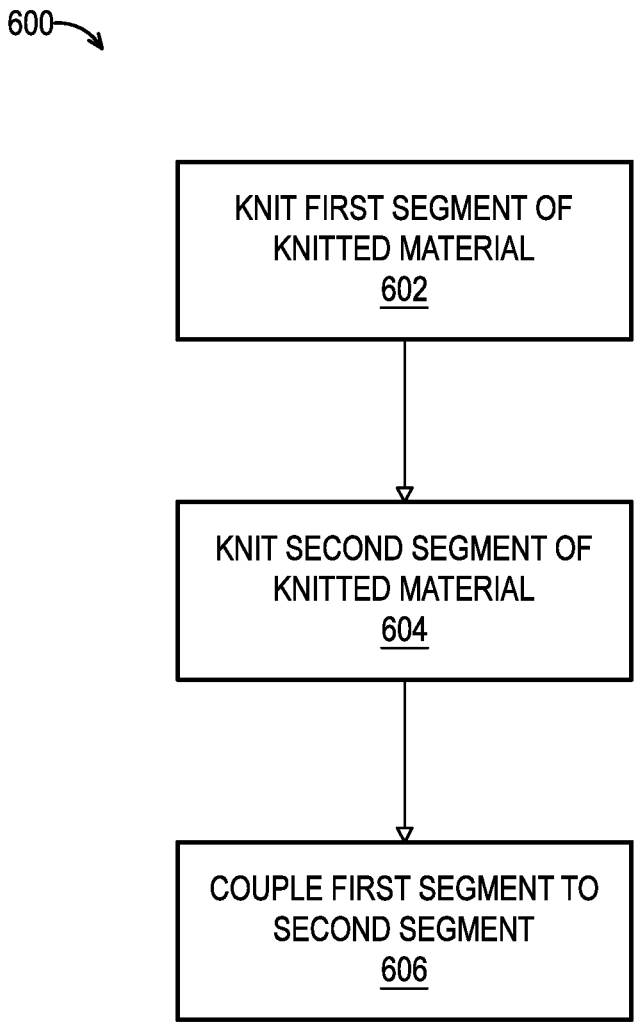
FIG. 14 is a flow chart depicting steps of a second illustrative method for manufacturing gripping socks in accordance with the present teachings.

This section describes steps of an illustrative method 600 for manufacturing socks including integrated internal and external gripping systems in accordance with the present teachings; see FIG. 14. Aspects of socks 100, 200, and 300 may be utilized in the method steps described below. Where appropriate, reference may be made to components and systems that may be used in carrying out each step. These references are for illustration, and are not intended to limit the possible ways of carrying out any particular step of the method.

FIG. 14 is a flowchart illustrating steps performed in an illustrative method, and may not recite the complete process or all steps of the method. Although various steps of method 600 are described below and depicted in FIG. 14, the steps need not necessarily all be performed, and in some cases may be performed simultaneously or in a different order than the order shown.

Step 602 of method 600 includes knitting a first segment of knitted material comprising gripping yarn forming integrated external and internal gripping systems. The first segment of knitted material is configured to extend along a long axis of a gripping sock. Accordingly, the first segment of knitting material may be configured to extend between a toe portion and a heel portion of a sock (e.g., a length of a sock body). In some examples, knitting a first segment of knitted material comprises utilizing a circular knitting machine, using a flatbed knitting machine, cutting a piece of prefabricated knitted material, weaving a segment of material, and/or the like. While the first segment of knitted material comprises gripping yarn, the first segment of knitted material may further comprise non-gripping yarn both plaited with the gripping yarn and within adjacent portions of knitted material.

The first segment of knitted material includes integrated external and internal gripping systems. Accordingly, the first segment of knitted material may have a knitting pattern resulting in external and internal surfaces of the first segment of knitted material having differing patterns of gripping stitches and non-gripping stitches. In some examples, the external and internal surfaces of the first segment of knitted material may have alternating courses including gripping yarn and non-gripping yarn. In some examples, the external and internal surfaces of the first segment of knitted material may comprise inverted knitting patterns. Accordingly, if a stitch configured to be disposed on an outer surface of a sole of the sock comprises a gripping stitch, a corresponding stitch disposed on an inner surface of the sole comprises a non-gripping stitch. Gripping stitches included within the external and internal gripping systems are configured such that gripping stitches are disposed at strategic locations within the inside and outside of the sock.

The external and internal gripping systems may be configured to collectively provide gripping force while reducing discomfort to a wearer. Controlling relative numbers and locations of stitches of the external gripping system compared to stitches of the internal gripping system may allow for tailoring of grip capabilities and the inclusion of localized grip areas within the sock. As the internal gripping system is an inversion of the external gripping system, different textures and patterns of the sole of the gripping sock result in socks having different amount of inside grip vs. outside grip. Accordingly, the internal gripping system may include fewer gripping stitches than the external gripping system, which facilitates reduced contact between gripping material and the skin of a wearer. Similarly, the internal gripping system may include gripping surfaces disposed in areas of the sock corresponding to low-sensitivity and/or non-weight bearing areas of the foot.

The first segment of knitted material includes an external "body yarn," an internal "plaiting yarn," and an elastic intertwined between the body and plaiting yarns. The external gripping system comprises outer gripping stitches of knitted material wherein at least one of the "body yarn" and the "plaiting yarn" comprise a gripping yarn. Similarly, the internal gripping system comprises inner gripping stitches of knitted material wherein at least one of the "body yarn" and the "plaiting yarn" comprise a gripping yarn. The gripping yarn may comprise any suitable material having high grabbing force, such as silicone, polyurethane, synthetic and/or natural rubbers, and/or the like. In some examples, the gripping yarn comprises a multifilament polyamide yarn having a silicone sheath. In some examples, one or more of the body yarn and the plaiting yarn may comprise polyester, cotton, wool, acrylic, polypropylene, high density polyethylene, and/or the like.

The first segment of knitted material may comprise any suitable knitted material having an "inside" and an "outside," such as single jersey, double jersey, ribbed fabric (e.g., 1×1 rib), interlock, and/or the like.

Step 604 of method 600 includes knitting a second segment of knitted material comprising non-gripping yarn. The second segment of knitted material is configured to extend along a long axis of a gripping sock, substantially parallel to the first segment of knitted material. Accordingly, the second segment of knitting material may be configured to extend between a toe portion and a heel portion of a sock (e.g., a length of a sock body). In some examples, knitting a second segment of knitted material comprises utilizing a circular knitting machine, using a flatbed knitting machine, cutting a piece of prefabricated knitted material, weaving a segment of material, and/or the like. While the first segment of knitted material comprises both gripping yarn and non-gripping yarn, the second segment of knitted material only comprises non-gripping yarn, such as yarns comprising polyester, cotton, wool, acrylic, polypropylene, high density polyethylene, and/or the like.

Steps 602 and 604 of method 600 may be repeated to produce any suitable number of gripping yarn segments and non-gripping yarn segments. In some examples, method 600 includes knitting two gripping yarn segments and two non-gripping yarn segments. In some examples, method 600 includes knitting two non-gripping yarn segments and one gripping yarn segment.

Step 606 of method 600 includes coupling the first segment of knitted material to the second segment of knitted material. Coupling the first segment of knitted material may include coupling long edges of the first segment of knitted material and the second segment of knitted material to form a tube. Coupling the first segment of knitted material to the second segment of knitted material may comprise any suitable method of attaching two pieces of knitted material, such as sewing, knitting (e.g., intarsia knitting), bonding, melting, gluing, and/or the like.

In some examples, steps 602, 604, and 606 may be carried out substantially simultaneously. Knitting a first segment of knitted material comprising gripping yarn, knitting a second segment of knitted material comprising non-gripping yarn, and coupling the first segment of knitted material to the second segment of knitting material may comprise utilizing a computerized knitting machine to knit the first segment and the second segment and to join the two segments using intarsia knitting.

Gripping yarns, such as silicone yarns, may be comparatively difficult to knit with circular knitting machines when compared with non-gripping yarns because of increased traction between the gripping yarns and needles of the computerized knitting machine (when compared with flatbed knitting machines). Accordingly, in examples wherein gripping socks are knitted on computerized circular knitting machines, the socks may be knitted in alternating segments extending along a long axis of the sock. For example, gripping yarn may be disposed only in a sole of the gripping sock, or may be disposed in areas of the sock which wrap only partially around the wearer's foot. Knitting the sock in segments may reduce frictional force between the yarn and the needles, as the yarn may experience less inward force during knitting.

Coupling the first segment of knitted material to the second segment of knitted material may comprise joining the two segments using intarsia knitting. Gripping yarns may also be difficult to knit with conventional knitting methods, as conventional knitting machines leave tails of cut yarn between knitted segments comprising different yarns. Gripping yarns may easily pull out of knitted fabric due to increased grabbing force between the yarn and a wearer's skin. Accordingly, intarsia knitting may be utilized to produce a seamless transition between gripping segments and non-gripping segments. Intarsia knitting interlocks yarn tails of adjacent segments, reducing cut yarn ends within a knitted material.

Accordingly, gripping sock 200 may comprise two or more alternating knitted segments extending along a long axis of the sock, at least one of which includes gripping yarn, and at least one of which does not include gripping yarn. In some examples, at least one of the gripping segments is disposed in a sole of the sock. The knitted segments may be joined together using intarsia knitting, and may accordingly have interlocked yarn tails between the knitted segments.

The following reference numerals may be utilized in the accompanying drawings:

100 first gripping sock, first gripping stocking
102 first heel region
104 first toe region
106 first sock body
108 first heel tab
110 first knit sock
112 first sole
120 first external gripping material
122 first outer surface
124 external gripping dots
130 first internal gripping material
132 first inner surface
134 internal gripping dots
200 second gripping sock, second gripping stocking
202 second heel region
204 second toe region
206 second sock body
208 sock leg
210 second knit sock
212 second sole
220 second external gripping system
222 second outer surface
224 external gripping stripes
230 second internal gripping system
234 internal gripping stripes
250 intarsia knit material
300 third gripping sock, third gripping stocking
302 third heel region
304 third toe region
306 third sock body
310 third knit sock
312 third sole
320 third external gripping system
322 third outer surface
330 third internal gripping system
400 first manufacturing method
600 second manufacturing method F. Illustrative Combinations and Additional Examples This section describes additional aspects and features of gripping socks, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

C0. A stocking comprising:

a knit sock;

a plurality of external gripping surfaces including first gripping pods comprising a first gripping material bonded to an exterior surface of the knit sock; and a plurality of internal gripping surfaces including second gripping pods comprising a second gripping material bonded to an interior surface of the knit sock;

wherein the internal gripping surfaces are configured to oppose relative motion between the stocking and a foot of a wearer in response to the wearer exerting frictional force between the plurality of external gripping surfaces and an underlying surface.

C1. The stocking of C0, wherein the plurality of first gripping pods are distributed such that a density of the pods is greater beneath a heel and a ball of the wearer's foot than in other areas.

C2. The stocking of any C0 or C1, wherein the plurality of second gripping pods are disposed in a heel region of the knit sock.

C3. The stocking of any one of paragraphs C0 through C2, wherein the first gripping material comprises natural fibers encapsulated in a polyurethane foam matrix.

C4. The stocking of any one of paragraphs C0 through C3, wherein the second gripping material comprises natural fibers encapsulated in a polyurethane foam matrix.

C5. The stocking of any one of paragraphs C0 through C4, wherein the first gripping pods are substantially semispherical in shape.

C6. The gripping sock of any one of paragraphs C0 through C5, wherein the second gripping pods are substantially flat.

C7. The gripping sock of any one of paragraphs C0 through C6, wherein the knit sock includes a sole, wherein the first gripping material is bonded to an exterior surface of the sole, and wherein the second gripping material is bonded to an interior surface of the sole.

D0. A gripping sock comprising:

a knit sock portion;

a first gripping material applied to an exterior surface of the knit sock portion in a first gripping pattern; and a second gripping material applied to an interior surface of the knit sock portion in a second gripping pattern;

wherein the first gripping material is configured to improve a coefficient of friction between the gripping sock and an underlying surface; and wherein the second gripping material is configured to improve a coefficient of friction between the gripping sock and a foot of a wearer.

D1. The gripping sock of paragraph D0, wherein the first gripping material comprises natural fibers encapsulated in a polyurethane foam matrix.

D2. The gripping sock of paragraph D0 or D1, wherein the second gripping material comprises natural fibers encapsulated in a polyurethane foam matrix.

D3. The gripping sock of any one of paragraphs D0 through D2, wherein the first gripping material comprises a plurality of first gripping pods or dots.

D4. The gripping sock of paragraph D3, wherein the first gripping pods or dots are substantially semispherical in shape.

D5. The gripping sock of paragraph D3 or D4, wherein the plurality of first gripping pods or dots are distributed such that a density of the pods or dots is highest in a ball and a heel region as compared with other regions of the sock.

D6. The gripping sock of any one of paragraphs D0 through D5, wherein the second gripping material comprises a plurality of second gripping pods or dots.

D7. The gripping sock of paragraph D6, wherein the second gripping pods or dots are substantially circular in shape.

D8. The gripping sock of paragraph D6 or D7, wherein the plurality of second gripping pods or dots are disposed in a heel region.

D9. The gripping sock of any of paragraphs D0 through D8, wherein the knit sock portion includes a sole, wherein the first gripping material is applied to an exterior surface of the sole, and wherein the second gripping material is applied to an interior surface of the sole.

E0. A method of manufacturing a gripping sock comprising:

bonding a plurality of first gripping pods comprising a first gripping material to an exterior surface of a knit sock; and bonding a plurality of second gripping pods comprising a second gripping material to an interior surface of the knit sock;

such that the plurality of second gripping pods are configured to retain the gripping sock on a foot of a wearer in response to the wearer exerting frictional force between the plurality of first gripping pods and an underlying surface.

E1. The method of paragraph E0, wherein bonding the plurality of first gripping pods includes activating a heat-activated adhesive.

E2. The method of paragraph E0 or E1, wherein bonding the plurality of second gripping pods includes activating a heat-activated adhesive.

E3. The method of any one of paragraphs E0 through E2, wherein the plurality of first gripping pods are distributed such that a density of the pods is highest in beneath the ball of a wearer's foot and the heel of a wearer's foot.

E4. The method of any one of paragraphs E0 through E3, wherein the plurality of second gripping pods are disposed beneath the heel of a wearer's foot.

E5. The method of any one of paragraphs E0 through E4, wherein the first gripping material comprises natural fibers encapsulated in a polyurethane foam matrix.

E6. The method of any one of paragraphs E0 through E5, wherein the second gripping material comprises natural fibers encapsulated in a polyurethane foam matrix.

E7. The method of any one of paragraphs E0 through E6, wherein the first gripping pods are substantially semispherical in shape.

E8. The method of any one of paragraphs E0 through E7, wherein the second gripping pods are substantially flat.

E9. The method of any one of paragraphs E0, E3 through E8, wherein bonding the plurality of first gripping pods includes injection molding the first gripping material such that it bonds to the exterior surface of the knit sock.

E10. The method of any one of paragraphs E0, E3 through E9, wherein bonding the plurality of second gripping pods includes injection molding the first gripping material such that it bonds to the interior surface of the knit sock.

E11. The method of any one of paragraphs E0, E3 through E8, wherein bonding the plurality of first gripping pods includes screen printing the first gripping material onto the exterior surface of the knit sock.

E12. The method of any one of paragraphs E0, E3 through E8, E11, wherein bonding the plurality of second gripping pods includes screen printing the second gripping material onto the interior surface of the knit sock.

F0. A stocking comprising:

a knit sock;

a first pattern of discrete external gripping surfaces disposed on an exterior surface of the knit sock; and a second pattern of discrete internal gripping surfaces disposed on an interior surface of the knit sock;

wherein the internal gripping surfaces are out of registration with respect to the external gripping surfaces, such that the first and second patterns are configured to improve traction by producing a shearing vector between foot-to-sock frictional forces and sock-to-underlying surface frictional forces.

F1. The stocking of F0, wherein the first pattern of discrete gripping surfaces comprises a plurality of first gripping pods bonded to the exterior surface.

F2. The stocking of F0 or F1, wherein the second pattern of discrete gripping surfaces comprises a plurality of second gripping pods bonded to the interior surface.

F3. The stocking of any one of paragraphs F0 through F2, wherein the first pattern of discrete gripping surfaces comprises a silicone-coated yarn of the knit sock exposed on the exterior surface.

F4. The stocking of F3, wherein the second pattern of discrete gripping surfaces comprises the silicone-coated yarn of the knit sock exposed on the interior surface.

F5. The stocking of any one of paragraphs F0 through F4, wherein the first pattern of discrete external gripping surfaces is configured such that a density of the discrete external gripping surfaces is greater beneath a heel region and a ball-of-foot region of the knit sock than in other areas of the exterior surface.

F6. The stocking of any one of paragraphs F0 through F5, wherein the second pattern of discrete internal gripping surfaces are disposed in a heel region of the knit sock.

F7. The stocking of any one of paragraphs F0 through F6, wherein the external gripping surfaces comprise a material including natural fibers encapsulated in a polyurethane foam matrix.

F8. The stocking of any one of paragraphs F0 through F7, wherein the external gripping surfaces have a rounded profile.

F9. The stocking of any one of paragraphs F0 through F8, wherein the internal gripping surfaces have a flat profile.

F10. The stocking of any one of paragraphs F0 through F9, wherein there is no overlap between the internal gripping surfaces and the external gripping surfaces.

F11. The stocking of any one of paragraphs F0 through F10, wherein the discrete external gripping surfaces of the first pattern are arranged in a gradient from an area of higher concentration to an area of lower concentration.

G0. A gripping sock comprising:

a knit sock portion; and a functional yarn woven into the knit sock portion, wherein the functional yarn is exposed on an exterior surface of the knit sock portion in a first pattern, and exposed on an interior surface of the knit sock portion in a second pattern;

wherein the first pattern is out of registration with the second pattern.

G1. The gripping sock of G0, wherein the functional yarn comprises silicone.

G2. The gripping sock of G0 or G1, wherein the first pattern comprises a distribution such that a density of the exposed functional yarn is highest in a ball-of-foot region and a heel region as compared to other regions of the sock.

G3. The gripping sock of any one of paragraphs G0 through G2, wherein the first pattern of functional yarn forms a plurality of laterally oriented stripes on a sole of the sock.

G4. The gripping sock of G3, wherein lateral ends of each of the stripes transition to a second yarn using an intarsia stitch.

G5. The gripping sock of any one of paragraphs G0 through G4, wherein the first and second patterns are mutually exclusive.

G6. The gripping sock of any one of paragraphs G0 through G5, wherein the exposed functional yarn of the first pattern is arranged in a gradient from an area of higher concentration to an area of lower concentration.

H0. A stocking comprising:

a knit sock;

a first pattern of discrete external gripping surfaces disposed on an exterior surface of the knit sock; and a second pattern of discrete internal gripping surfaces disposed on an interior surface of the knit sock;

wherein the internal gripping surfaces are out of registration with respect to the external gripping surfaces, and the first pattern has a different density than the second pattern, as measured by a number of the gripping surfaces per centimeter.

H1. The stocking of H0, wherein the first pattern of discrete gripping surfaces comprises a plurality of first gripping pods bonded to the exterior surface, and the second pattern of discrete gripping surfaces comprises a plurality of second gripping pods bonded to the interior surface.

H2. The stocking of H0 or H1, wherein the first pattern of discrete gripping surfaces comprises a silicone-coated yarn of the knit sock exposed on the exterior surface, and the second pattern of discrete gripping surfaces comprises the silicone-coated yarn of the knit sock exposed on the interior surface.

H3. The stocking of any one of paragraphs H0 through H2, wherein the discrete external gripping surfaces of the first pattern are arranged in a gradient from an area of higher concentration to an area of lower concentration.

Advantages, Features, and Benefits

The different embodiments and examples of the socks including integrated gripping systems described herein provide several advantages over known gripping socks. For example, illustrative embodiments and examples described herein improve a wearer's sensation of balance by reducing slippage.

Additionally, and among other benefits, illustrative embodiments and examples described herein achieve a higher level of grip on wet surfaces than conventional silicone gripping materials.

Additionally, and among other benefits, illustrative embodiments and examples described herein grip the foot without interfering with sweat absorption.

Additionally, and among other benefits, illustrative embodiments and examples described herein facilitate knitting a seamless sock with gripping yarn, which improves sock durability.

Additionally, and among other benefits, illustrative embodiments and examples described herein facilitate dissipation of heat resulting from frictional forces experienced by the sock.

Additionally, and among other benefits, illustrative embodiments and examples described herein utilize intarsia knitting to produce a smooth interior of the sock, substantially free of loose ends of yarn.

Additionally, and among other benefits, illustrative embodiments and examples described herein alternate grip/no-grip yarns between a skin-facing surface and an outer surface, improving the fit, comfort, perceptive sensation of traction/stability for the user. Including traction yarns only on the outside of the sock may cause the foot to slip/roll off of the sock when down force is applied during lateral motions. Including traction yarns only on the inside of the sock may cause slippage to be perceived to be the sock sliding on the floor. When traction yarns are placed in registration on both the inside and outside of the sock, the wearer may perceive hot spots when force is applied, as well as a perception that the foot bottom is hot and/or sweaty. By instead alternating the yarns, the perceived fit and sensation of comfort is improved over these other alternatives.

Additionally, and among other benefits, illustrative embodiments and examples described herein alternate the grip yarn between skin-facing surfaces and outer surfaces facilitates tuning of the performance of the grip to specific activities.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A stocking comprising:

a knit sock;

a first pattern of discrete external gripping surfaces disposed on an exterior surface of the knit sock, wherein the first pattern of discrete external gripping surfaces comprises outer courses of knitted material formed by a first body yarn and a first plaiting yarn, wherein at least one of the first body yarn and the first plaiting yarn comprises a gripping yarn; and a second pattern of discrete internal gripping surfaces disposed on an interior surface of the knit sock, wherein the second pattern of discrete internal gripping surfaces comprises inner courses of knitted material formed by a second body yarn and a second plaiting yarn, wherein at least one of the second body yarn and the second plaiting yarn comprises a gripping yarn;

wherein the discrete internal gripping surfaces are out of registration with respect to the discrete external gripping surfaces, such that the first and second patterns are configured to improve traction by producing a shearing vector between foot-to-sock frictional forces and sock-to-underlying surface frictional forces.

2. The stocking of claim 1, wherein the first pattern of discrete external gripping surfaces comprises a silicone-coated yarn of the knit sock exposed on the exterior surface.

3. The stocking of claim 2, wherein the second pattern of discrete internal gripping surfaces comprises the silicone-coated yarn of the knit sock exposed on the interior surface.

4. The stocking of claim 1, wherein the first pattern of discrete external gripping surfaces is configured such that the discrete external gripping surfaces are concentrated beneath a heel region and a ball-of-foot region of the knit sock.

5. The stocking of claim 1, wherein the discrete external gripping surfaces of the first pattern are arranged in a gradient from an area of higher concentration to an area of lower concentration.

6. The stocking of claim 1, wherein the second pattern of discrete internal gripping surfaces are disposed in a heel region of the knit sock.

7. The stocking of claim 1, wherein there is no overlap between the discrete internal gripping surfaces and the discrete external gripping surfaces.

8. A gripping sock comprising:

a knit sock portion; and a functional yarn knitted into the knit sock portion, wherein the functional yarn is exposed on an exterior surface of the knit sock portion in a first pattern, wherein the first pattern comprises outer courses of knitted material formed by a first body yarn and a first plaiting yarn, wherein at least one of the first body yarn and the first plaiting yarn comprises the functional yarn;

wherein the functional yarn is exposed on an interior surface of the knit sock portion in a second pattern, wherein the second pattern comprises inner courses of knitted material formed by a second body yarn and a second plaiting yarn, wherein at least one of the second body yarn and the second plaiting yarn comprises the functional yarn; and wherein the first pattern is out of registration with the second pattern.

9. The gripping sock of claim 8, wherein the functional yarn comprises silicone.

10. The gripping sock of claim 8, wherein the first pattern comprises a distribution such that the outer courses of knitted material and the inner courses of knitted material are both concentrated in a ball-of-foot region and a heel region of the sock.

11. The gripping sock of claim 8, wherein the functional yarn exposed on the exterior surface of the knit sock portion in the first pattern is arranged in a gradient from an area of higher concentration to an area of lower concentration.

12. The gripping sock of claim 8, wherein external gripping stripes comprising the functional yarn in the first pattern are laterally oriented and disposed on a sole of the sock.

13. The gripping sock of claim 12, wherein lateral ends of the external gripping stripes transition to a second yarn using an intarsia stitch.

14. The gripping sock of claim 8, wherein the first and second patterns are mutually exclusive.

15. A stocking comprising:

a knit sock comprising a first plaiting yarn and a first body yarn, at least one of which comprises a silicone-coated yarn, and a second plaiting yarn and a second body yarn, at least one of which comprises the silicone-coated yarn;

a first pattern of discrete external gripping surfaces disposed on an exterior surface of the knit sock, wherein the first pattern of discrete external gripping surfaces disposed on the exterior surface comprises outer courses of knitted material formed by the first plaiting yarn and the first body yarn; and a second pattern of discrete internal gripping surfaces disposed on an interior surface of the knit sock, wherein the second pattern of discrete internal gripping surfaces disposed on the interior surface comprises inner courses of knitted material formed by the second plaiting yarn and the second body yarn;

wherein the discrete internal gripping surfaces are out of registration with respect to the discrete external gripping surfaces; and wherein the first pattern of discrete external gripping surfaces comprises the silicone-coated yarn of the knit sock exposed on the exterior surface, and the second pattern of discrete internal gripping surfaces comprises the silicone-coated yarn of the knit sock exposed on the interior surface.

16. The stocking of claim 15, wherein the discrete external gripping surfaces of the first pattern are arranged in a gradient from an area of higher concentration to an area of lower concentration.

17. The stocking of claim 15, wherein the first pattern of discrete external gripping surfaces disposed on the exterior surface comprises external gripping stripes, wherein the second pattern of discrete internal gripping surfaces disposed on the interior surface comprises internal gripping stripes, and wherein the internal gripping stripes are thinner than the external gripping stripes.

* * * * *